US007310598B1

(12) United States Patent
Mikhael et al.

(10) Patent No.: US 7,310,598 B1
(45) Date of Patent: Dec. 18, 2007

(54) ENERGY BASED SPLIT VECTOR QUANTIZER EMPLOYING SIGNAL REPRESENTATION IN MULTIPLE TRANSFORM DOMAINS

(75) Inventors: Wasfy Mikhael, Winter Spring, FL (US); Venkatesh Krishnan, Atlanta, GA (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 865 days.

(21) Appl. No.: 10/412,093

(22) Filed: Apr. 11, 2003

Related U.S. Application Data

(60) Provisional application No. 60/372,521, filed on Apr. 12, 2002.

(51) Int. Cl.
*G10L 19/00* (2006.01)

(52) U.S. Cl. ..... 704/230; 704/203; 704/222

(58) Field of Classification Search ..... 704/230, 704/203, 222
See application file for complete search history.

(56) References Cited

U.S. PATENT DOCUMENTS

| | | | | |
|---|---|---|---|---|
| 4,751,742 A | | 6/1988 | Meeker | 382/41 |
| 5,402,185 A | | 3/1995 | DeWith et al. | 348/407 |
| 5,513,128 A | | 4/1996 | Rao | 364/514 |
| 5,563,661 A | | 10/1996 | Takahashi et al. | 348/390 |
| 5,703,704 A | | 12/1997 | Nakagawa et al. | 359/9 |
| 5,729,655 A | * | 3/1998 | Kolesnik et al. | 704/223 |
| 5,832,443 A | * | 11/1998 | Kolesnik et al. | 704/500 |
| 5,870,145 A | | 2/1999 | Yada et al. | 348/405 |
| 5,901,178 A | | 5/1999 | Lee et al. | 375/240 |
| 6,024,287 A | | 2/2000 | Takai et al. | 235/493 |
| 6,067,515 A | | 5/2000 | Cong et al. | 704/243 |
| 6,094,631 A | * | 7/2000 | Li et al. | 704/230 |
| 6,198,412 B1 | * | 3/2001 | Goyal | 341/50 |
| 6,269,332 B1 | * | 7/2001 | Choo et al. | 704/233 |
| 6,345,125 B2 | * | 2/2002 | Goyal et al. | 382/251 |
| 2001/0017941 A1 | * | 8/2001 | Chaddha | 382/236 |
| 2001/0051005 A1 | * | 12/2001 | Itagaki et al. | 382/250 |

OTHER PUBLICATIONS

Mikhael, W.B., and Spanias, A., "Accurate Representation of Time Varying Signals Using Mixed Transforms with Applications to Speech," *IEEE Trans. Circ. and Syst.*, vol. CAS-36, No. 2, pp. 329, Feb. 1989.

(Continued)

*Primary Examiner*—Richemond Dorvil
*Assistant Examiner*—Qi Han
(74) *Attorney, Agent, or Firm*—Brian S. Steinberger; Phyllis K. Wood; Law Offices of Brian S. Steinberger, P.A.

(57) ABSTRACT

The invention relates to representation of one and multidimensional signal vectors in multiple nonorthogonal domains and design of Vector Quantizers that can be chosen among these representations. There is presented a Vector Quantization technique in multiple nonorthogonal domains for both waveform and model based signal characterization. An iterative codebook accuracy enhancement algorithm, applicable to both waveform and model based Vector Quantization in multiple nonorthogonal domains, which yields further improvement in signal coding performance, is disclosed. Further, Vector Quantization in multiple nonorthogonal domains is applied to speech and exhibits clear performance improvements of reconstruction quality for the same bit rate compared to existing single domain Vector Quantization techniques. The technique disclosed herein can be easily extended to several other one and multidimensional signal classes.

8 Claims, 21 Drawing Sheets

OTHER PUBLICATIONS

Mikhael, W.B., and Ramaswamy, A., "An efficient representation of nonstationary signals using mixed-transforms with applications to speech," *IEEE Trans. Circ. and Syst. II: Analog and Digital Signal Processing*, vol. 42 Issue: 6, pp. 393-401, Jun. 1995.

Mikhael, W.B., and Ramaswamy, A, "Application of Multitransforms for lossy Image Representation," *IEEE Trans. Circ. and Syst. II: Analog and Digital Signal Processing*, vol. 41 Issue: 6, pp. 431-434 Jun. 1994.

Berg, A.P., and Mikhael, W.B., "A survey of mixed transform techniques for speech and image coding," *Proc. of the 1999 IEEE International Symposium Circ. and Syst., ISCAS '99*, vol. 4, 1999.

Berg, A.P., and Mikhael, W.B., "An efficient structure and algorithm for image representation using nonorthogonal basis images," *IEEE Trans. Circ. and Syst. II*, pp. 818-828 vol. 44 Issue:10, Oct. 1997.

Berg, A.P., and Mikhael, W.B., "Formal development and convergence analysis of the parallel adaptive mixed transform algorithm," *Proc. of 1997 IEEE International Symposium Circ. and Syst.*, vol. 4,1997 pp. 2280-2283 vol. 4.

Ramaswamy, A., and Mikhael, W.B., "A mixed transform approach for efficient compression of medical images," *IEEE Trans. Medical Imaging*, pp. 343-352, vol. 15 Issue: 3, Jun. 1996.

Ramaswamy, A., Mikhael, W.B., "Multitransform applications for representing 3-D spatial and spatio-temporal signals," *Conference Record of the Twenty-Ninth Asilomar Conference on Signals, Syst. and Computers*, vol. 2, 1996.

Mikhael., W.B., and Ramaswamy, A., "Resolving Images in Multiple Transform Domains with Applications," *Digital Signal Processing—A Review*, pp. 81-90, 1995.

Ramaswamy, A., Zhou, W., and Mikhael, W.B., "Subband Image Representation Employing Wavelets and Multi-Transforms," *Proc. of the 40th Midwest Symposium Circ. and Syst.*, vol. 2, pp. 949-952, 1998.

Mikhael, W.B., and Berg, A.P., "Image representation using nonorthogonal basis images with adaptive weight optimization," *IEEE Signal Processing Letters*, vol. 3 Issue: 6, pp. 165-167, Jun. 1996.

Berg, A.P., and Mikhael, W.B., "Fidelity enhancement of transform based image coding using nonorthogonal basis images," *1996 IEEE International Symposium Circ. and Syst.*, pp. 437-440 vol. 2, 1996.

Berg, A.P., and Mikhael, W.B., "Approaches to High Quality Speech Coding Using Gain-Adaptive Vector Quantization," pp. 612-615, Proc. of Midwest Symposium on Circuits and System 1992.

Linde, et al. "An Algoithm for Vector Quantizer Design" IEEE Transactions on Communication, vol. Com-28, No. 1, Jan. 1980, pp. 84-95.

Makhoul, "Linear Prediction: A Tutorial Review", IEEE, vol. 63, No. 4, Apr. 1975, pp. 561-580.

Itakura, et al. Line spectrum representation of linear predictor coefficients of speech signals, 3:48.

Gray, et al., "Quantization and Bit Allocation in Speech Processing", IEEE Transactions on Acoustics, Speech, and Signal Processing, vol. ASSP-24, No. 6, Dec. 1976, pp. 459-473.

Paliwal, et al. "Efficient Vector Quantization of LPC Parameters at 24 Bits/Frame", IEEE Transactions on Speech and Audio Processing, vol. 1, No. 1, Jan. 1993, pp. 3-14.

Spanias A., "Speech Coding: A Tutorial Review," Proc. of the IEEE, vol. 82, No. 10, Oct. 1994, pp. 1539-1582.

* cited by examiner 0.01
0
-0.01
0
200
400
600
800
1000
1200
1400
1600
1800
2000

1
0
-1
0.01
-0.01
0 0.2 0.4 0.6 0.8 1 1.2 1.4 1.6 1.8 2
Time (secs)

——— Using The ACAE Algorithm
- - - - - Without Employing ACAE Algorithm

——— Using The ACAE Algorithm
- - - - - Without Employing ACAE Algorithm

ENERGY BASED SPLIT VECTOR QUANTIZER EMPLOYING SIGNAL REPRESENTATION IN MULTIPLE TRANSFORM DOMAINS

The invention relates to representation of one and multidimensional signal vectors in multiple nonorthogonal domains and in particular to the design of Vector Quantizers that choose among these representations which are useful for speech applications and this Application claims the benefit of United States Provisional Application No. 60/372,521 filed Apr. 12, 2002.

BACKGROUND AND PRIOR ART

Naturally occurring signals, such as speech, geophysical signals, images, etc., have a great deal of inherent redundancies. Such signals lend themselves to compact representation for improved storage, transmission and extraction of information. Efficient representation of one and multidimensional signals, employing a variety of techniques has received considerable attention and many excellent contributions have been reported.

Vector Quantization is a powerful technique for efficient representation of one and multidimensional signals [see Gersho A.; Gray R. M. Vector Quantization and Signal Compression, Kluwer Academic Publishers, 1991.] It can also be viewed as a front end to a variety of complex signal processing tasks, including classification and linear transformation. It has been shown that if an optimal Vector Quantizer is obtained, under certain design constraints and for a given performance objective, no other coding system can achieve a better performance. An n dimensional Vector Quantizer V of size K uniquely maps a vector x in an n dimensional Euclidean space to an element in the set S that contains K representative points i.e., $$V{:}x\epsilon R^n \rightarrow C(x)\epsilon S$$

Vector Quantization techniques have been successfully applied to various signal classes, particularly sampled speech, images, video etc. Vectors are formed either directly from the signal waveform (Waveform Vector Quantizers) or from the LP model parameters extracted from the signal (Mode based Vector Quantizers). Waveform vector quantizers often encode linear transform, domain representations of the signal vector or their representations using Multiresolution wavelet analysis. The premise of a model based signal characterization is that a broadband, spectrally flat excitation is processed by an all pole filter to generate the signal. Such a representation has useful applications including signal compression and recognition, particularly when Vector Quantization is used to encode the model parameters.

Recently, it has been shown that representation of signals in multiple nonorthogonal domains of representation reveals unique signal characteristics that may be exploited for encoding signals efficiently. See: Mikhael, W. B., and Spanias, A., "Accurate Representation of Time Varying Signals Using Mixed Transforms with Applications to Speech," IEEE Trans. Circ. and Syst., vol. CAS-36, no: 2, pp. 329, February 1989; Mikhael, W. B., and Ramaswamy, A., "An efficient representation of nonstationary signals using mixed-transforms with applications to speech," IEEE Trans. Circ. and Syst. II: Analog and Digital Signal Processing, vol: 42 Issue: 6, pp: 393-401, June 1995; Mikhael, W. B., and Ramaswamy, A, "Application of Multitransforms for lossy Image Representation," IEEE Trans. Circ. and Syst. II: Analog and Digital Signal Processing, vol: 41 Issue: 6, pp. 431-434 June 1994; Berg, A. P., and Mikhael, W. B., "A survey of mixed transform techniques for speech and image coding," Proc. of the 1999 IEEE International Symposium Circ. and Syst., ISCAS '99, vol. 4, 1999; Berg, A. P., and Mikhael, W. B., "An efficient structure and algorithm for image representation using nonorthogonal basis images," IEEE Trans. Circ. and Syst. II, pp: 818-828 vol. 44 Issue: 10, October 1997; Berg, A. P., and Mikhael, W. B., "Formal development and convergence analysis of the parallel adaptive mixed transform algorithm," Proc. of 1997 IEEE International Symposium Circ. and Syst., Vol. 4,1997 pp. 2280-2283; Ramaswamy, A., and Mikhael, W. B., "A mixed transform approach for efficient compression of medical images," IEEE Trans. Medical Imaging, pp. 343-352, vol 15 Issue: 3, June 1996; Ramaswamy, A., and Mikhael, W. B., "Multitransform applications for representing 3-D spatial and spatio-temporal signals," Conference Record of the Twenty-Ninth Asilomar Conference on Signals, Syst. and Computers, vol: 2, 1996; Mikhael, W. B., and Ramaswamy, A., "Resolving Images in Multiple Transform Domains with Applications," Digital Signal Processing—A Review, pp. 81-90, 1995; Ramaswamy, A., Zhou, W., and Mikhael, W. B., "Subband Image Representation Employing Wavelets and Multi-Transforms," Proc. of the 40th Midwest Symposium Circ. and Syst., vol: 2, pp: 949-952, 1998;. Mikhael, W. B., and Berg, A. P., "Image representation using nonorthogonal basis images with adaptive weight optimization," IEEE Signal Processing Letters, vol: 3 Issue: 6, pp: 165-167, June 1996; and Berg, A. P., and Mikhael, W. B., "Fidelity enhancement of transform based image coding using nonorthogonal basis images," 1996 IEEE International Symposium Circ. and Syst., pp. 437-440 vol. 2, 1996.]

A search was carried out which encompassed a novel software system which overcame the problem of transmitting different types of data such as speech, image, video data within a limited bandwidth. The searched system of the invention hereafter disclosed initially passes data separately through various transform domains such as Fourier Transform, Discrete Cosine Transform (DCT), Haar Transform, Wavelet Transform, etc. In a learning mode the invention represents the data signal transmissions in each domain using a coding scheme (e.g. bits) for data compression such as a split vector quantization scheme with a novel algorithm. Next, the invention evaluates each of the different domains and picks out which domain move accurately represents the transmitted data by measuring distortion. The dynamic system automatically picks which domain is better for the particular signal being transmitted.

The search produced the following nine patents:

U.S. Pat. No. 4,751,742 to Meeker proposes methods for prioritization of transform domain coefficients and is applicable to pyramidal transform coefficients and deals only with a single transform domain coefficient that is arranged according to a priority criterion;

U.S. Pat. No. 5,402,185 to De With, et al discloses a motion detector which is specifically applicable to encoding video frames where different transform coding techniques are selected on the determination of motion;

U.S. Pat. No. 5,513,128 to Rao proposes multispectral data compression using inter-band prediction wherein multiple spectral bands are selected from a single transform domain representation of an image for compression;

U.S. Pat. No. 5,563,661 to Takahashi, et al. discloses a method specifically applicable to image compression where a selector circuits picks up one of many photographic modes and uses multiple nonorthogonal domain representations for signal frames with an encoder that picks up a domain of representation that meets a specific criterion;

U.S. Pat. No. 5,703,704 to Nakagawa, et al. discloses a stereoscopic image transmission system which does not employ signal representation in multiple domains;

U.S. Pat. No. 5,870,145 to Yada, et al. discusses a quantization technique for video signals using a single transform domain although a multiple nonorthogonal domain Vector Quantization is proposed;

U.S. Pat. No. 5,901,178 to Lee, et al. describes a post-compression hidden data transport for video signals in which they extract video transform samples in a single transform domain from a compressed packetized data stream and use spread spectrum techniques to conceal the video data;

U.S. Pat. No. 6,024,287 to Takai, et al. discloses a Fourier Transform based technique for a card type recording medium where only a single domain of representation of information is employed: and, U.S. Pat. No. 6,067,515 to Cong, et al. discloses a speech recognition system based upon both split Vector Quantization and split matrix quantization which materially differs from a multiple domain vector quantization where vectors formed from a signal are represented using codebooks in multiple redundant domains.

It would be highly desirable to provide a vector quantization approach in multiple nonorthogonal domains for both waveform and model based signal characterization.

SUMMARY OF THE INVENTION

The first objective of the invention is to present a novel Vector Quantization technique in multiple nonorthogonal domains for both waveform and model based signal characterization.

A further objective is to demonstrate an example application of Vector Quantization in multiple nonorthogonal domains, to one of the most commonly used signals, namely speech.

A preferred embodiment of the invention utilizes a software system comprising the steps of: initially passing data separately through various transform domains such as Fourier Transform, Discrete Cosine Transform (DCT), Haar Transform, Wavelet Transform, etc; then during the learning mode the resulting data signal transmissions in each domain uses a coding scheme (e.g. bits) for data compression such as a split vector quantization scheme with a novel algorithm; and, evaluates each of the different domains and picks out which domain more accurately represents the transmitted data by measuring the extent of distortion by means of a dynamic system which automatically picks which domain is better for the particular signal being transmitted.

The resulting performance improvement is clearly demonstrated in term of reconstruction quality for the same bit rate compared to existing single domain Vector Quantization techniques. Although one-dimensional speech signals are used to demonstrate the improved performance of the proposed method, the technique developed can be easily extended to several other one and multidimensional signal classes. An iterative codebook accuracy enhancement algorithm, applicable to both waveform and model based Vector Quantization in Multiple Nonorothgonal Domains, which yields further improvement in signal coding performance, is subsequently presented.

Further objects and advantages of this invention will be apparent from the following detailed description of presently preferred embodiments which are illustrated schematically in the accompanying drawings.

BRIEF DESCRIPTION OF THE FIGURES

FIG. 6(*b*) Vector Quantized Reconstruction at 2 bits/sample sampled at 8000 Samples/sec, and vector lengths of 32 samples.

FIG. 6(*c*) error signal speech sampled at 8000 Samples/sec, and vector lengths of 32 samples.

FIG. 14(*b*) shows SNR vs. bits per frame for reconstruction of signal shown in FIG 15 for the following: (i) Encoding LP coefficients using LSP and residues using HAAR; (ii) Encoding LP coefficients using LAR and residues using DCT; and, (iii) Encoding the LP coefficients and residuals using the proposed LP-MND-VQ-S.

FIG. 18 (*b*) shows SNR improvement (training mode) vs. iteration index employing the ACAE algorithm applied to VQMND-W for 1.375 bps.

FIG. 18 (*c*) shows SNR improvement (training mode) vs. iteration index employing the ACAE algorithm applied to VQMND-W for 1.5 bps.

FIG. 20 (*b*) shows SNR improvement (training mode) vs. iteration index employing the ACAE algorithm applied to VQMND-W for 0.875 bps.

FIG. 20 (*c*) shows SNR improvement (training mode) vs. iteration index employing the ACAE algorithm applied to VQMND-W for 1 bps.

FIG. 20 (*d*) shows SNR improvement (training mode) vs. iteration index employing the ACAE algorithm applied to VQMND-W for 1.1 bps.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Firstly, in Section 1, an overall framework of our invention, Vector Quantization in Multiple Non orthogonal Domain (VQMND) for both waveform and model based coding of one and multidimensional signals is presented. In Section 2, the preferred embodiment for a waveform coder employing VQMND, designated VQMND-W, is developed. Extensive simulation results using one dimensional speech signals are given. Following a detailed description of a model based coder using VQMND, designated VQMND-M is presented in Section 3. Finally, in Section 4, the adaptive codebook accuracy enhancement (ACAE) algorithm is presented and simulation results are provided to demonstrate the further improvement in VQMND-W and VQMND-M when the ACAE algorithm is used.

Section 1: General Framework

Figure 1:
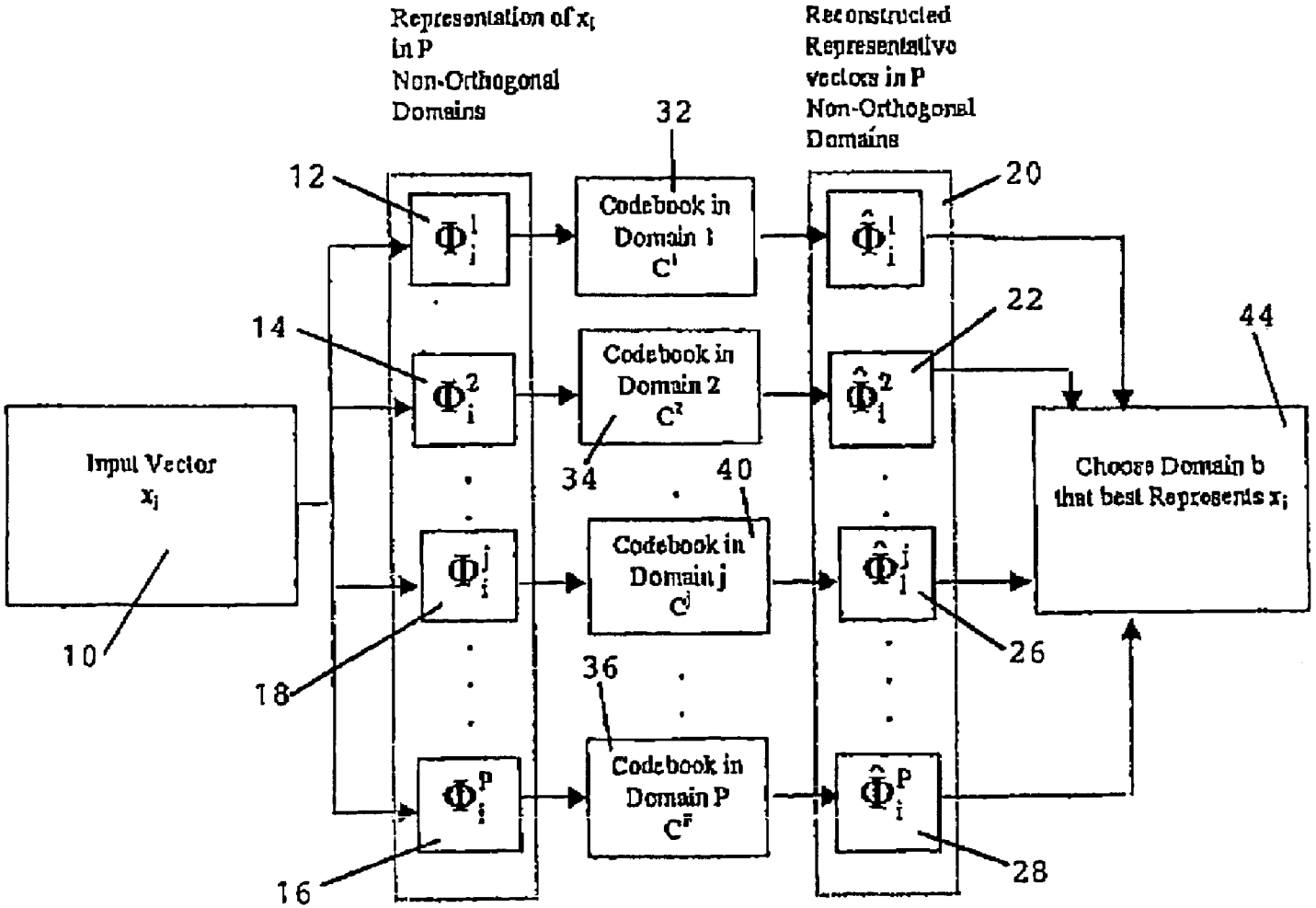
FIG. 1 shows a Multiple Transform Domain Split Vector Quantizer (MTDSVQ).

In this section, a brief description of Vector Quantization in Multiple Nonorthogonal Domains for Waveform Coding (VQMND-W) and Vector Quantization in Multiple Nonorthogonal Domains for Model Based Coding VQMND-M is presented. The following convention for representation is established:

Referring now to FIG. 1, in this invention, the vector obtained from a windowed signal, is represented by $x_i$ 10. Here i represents the index of the windowed segment of the signal of length N. For waveform coding, the vector $x_i$ 10 is formed from N time domain signal samples. For LP model based coding, a vector $x_i$ is formed corresponding to the LP model coefficients as well as the prediction residuals, extracted from the windowed signal. The representation of the vector $x_i$ in P nonorthogonal domains is denoted $\Phi^j_i$ for domains j-1, 12, 2 14 . . . , P 16 and j 18. The block diagram of the VQMND is given in FIG. 1.

For efficient encoding of $x_i$, a large number of bits has to be allocated for each vector. This may cause the codebook size to be prohibitively large. The problem is addressed by using a suboptimal split or partitioned vector quantization technique [see Gersho, A., and Gray, R. M., "Vector Quantization and Signal Compression," Kluwer Academic Publishers, 1991.]

Section 2: VQMND for Waveform Coding of Signals (VQMND-W)

Among various signal-coding methods, transform domain representation and analysis-synthesis model based coding techniques are widely used. Appropriately selected linear transform domain representations compact the signal information in fewer coefficients than time/space domain representation.

2.1 Multiple Transform Split Vector Quantizer Codebook Design

Different linear transform domain representations have different energy compaction properties. The vector quantization technique described in this invention uses a multiple transform domain representation. Prior to codebook formation, signal vectors are formed from n successive samples of speech and the energy in each vector is normalized. The normalization factor, called the gain, is encoded separately using 8 bits. Alternatively, a factor to normalize the dynamic range for different vectors can be used [see Berg, A. P.; Mikhael, W. B. Approaches to High Quality Speech Coding using Gain Adaptive Vector Quantization. Proc of Midwest Symposium on Circuits and Systems, 1992.].

Each vector is transformed simultaneously into P non-orthogonal linear transform domains. The vectors are then split into M subbands, generally of different lengths, each containing approximately 1/M of the total normalized average signal energy. In the $K^{th}$ transform domain, the $m^{th}$ subvector denoted by $\Phi^j_{im}$ where j−1 to P as indicated by 20, 22, 26 and 28, m=1 to M, and the number of coefficients in that subvector is denoted by $L^j_m$.

Thus, $$\sum_{m=1}^{M} L^j_m = n \quad K = 1, 2, \ldots P \tag{2}$$

The training subvectors corresponding to $\Phi_{im}^{\ j}$ are clustered using k-mcans clustering algorithm [see Linde Y.; Buzo A.; Gray R. M. An Algorithm for Vector Quantizer Design. IEEE Transactions on Communication, COM-28: pp. 702-710, 1980.] and the codebook $C_m^{\ j}$ is designed, where each codeword $c_m^{\ j}$ corresponds to a centroid $\hat{\Phi}_m^{\ j}$. Since the energy content in each subband is nearly the same, an equal number of bits is allotted to each subband.

2.2 Multiple Transform Split Vector Quantizer: Encoder

In the running mode, signal vectors formed from input speech samples are partitioned to form subvectors corresponding to $\Phi_{im}^{\ j}$ 18. Each of these sections is mapped to its corresponding codebook $C_m^{\ j}$ e.g., $\hat{\Phi}_i^1$ 12 to codebook 32, $\hat{\Phi}^{i2}$ 14 to codebook 34, $\hat{\Phi}_i^P$ 16 to codebook 36, and $\hat{\Phi}_i^j$ 18 to codebook 40 and the code words are concatenated to form $C_j=[c_1^{\ j}\ c_2^{\ j}, \ldots c_M^{\ j}]$. The representative vector in each domain, $\hat{\Phi}_i^j=[\hat{\Phi}_{i1}^{\ j}, \hat{\Phi}_{i2}^{\ j}, \ldots \hat{\Phi}_{iM}^{\ j}[$ is also formed by concatenation of the representative vectors of the subband sections of that domain. The domain whose representative vector best approximates the input vector in terms of the least squared distortion is chosen to represent the input and an index pointing to the chosen domain is appended to the code word. This index does not add any significant overhead to the codewords since a large number of transform domains may be indexed using a few bits. This is especially true for long vectors. The energy in the error for each transform domain representation is computed. Thus, if $\Phi_i^j$ and $\hat{\Phi}_i^j$ are the input vector and the reconstructed representative vector in the $j^{th}$ transform domain, respectively, then domain b selected to represent the input vector, $x_i$, is chosen such that $$\|\Phi_i^b-\hat{\Phi}_i^b\|^2 < \|\Phi_i^j-\hat{\Phi}_i^j\|^2 \text{ for all } j=1, 2 \ldots, P \text{ and } j\neq b. \quad (3)$$

where ||.|| represents the Euclidian norm. The index b is appended to the codeword to identify the domain b, 44 that was chosen to represent vector $x_i$.

2.3 Multiple Transform Split Vector Quantizer: Decoder

The decoder receives the concatenated codeword $C^j_i$ and the information about the transform k used to encode the speech sample vector. The decoder then accesses the codebook corresponding to the transform j. The received codeword $C^j_i$ is split into the codewords for each subvector of the vector. These codewords $C_K=[C_{K1}, C_{K2}, C_{K3}, \ldots C_{KM}]$ are then mapped to the corresponding codebooks according to the mapping relationship given by $$C_{im}^j \rightarrow \hat{\Phi}_{im}^j \quad (4)$$

The subvectors, $\hat{\Phi}_{im}^j$, are then concatenated to form the transformed speech vector. Inverse transform operation is then performed on $\hat{\Phi}_{im}^j$ to obtain the normalized speech vector. Multiplication of these normalized speech vectors with the normalization factor yields the denormalized speech vector. Concatenation of consecutive speech vectors reconstructs the original speech waveform.

2.4 Results

The performance of the VQMND-W is evaluated in terms of the signal to noise ratio (SNR) of the reconstructed waveform as a function of the average number of Bits Per Sample (BPS). The SNR is calculated by:

$$SNR = 10\times\log_{10}\left(\frac{\sum_{i=1}^{N} x_i^2}{\sum_{i=1}^{N}(s_i-x_i)^2}\right) \quad (5)$$

Where $x_i$ is th $i^{th}$ sample of the one-dimensional input speech signal of length N and $s_i$ is the corresponding sample in the reconstructed waveform.

The codebook for VQMND-W is designed using a 130 second segment of speech sampled at 8000 Samples/second. Prior to processing the signal using the proposed VQMND-W, the input samples are 16 bit quantized. Here, training vectors of 32 samples, the represent 4 ms of sampled speech, are formed. Each vector is transformed into two transform domains: Discrete Cosine Transform (DCT) and HAAR, i.e. P=2, and split into four subvectors corresponding to M=4. The average energy in each transform coefficient is calculated and the boundaries for each subband of the vector in both the transform domains are found. The number of coefficients that constitute each of the subbands $L_{km}$ and the percentage of total vector energy they contain are shown in Table 1. Training subvectors belonging to each subband of each transform are then collected and clustered using the k-means clustering algorithm.

The average number of bits per sample is calculated by dividing the total number of bits used to represent the concatenation of code words corresponding to each constituent subvector by the total length of the vector.

In the running mode, testing speech vectors of 32 samples are formed. As for the training, each testing vector is transformed into two transform domains: DCT and HAAR, i.e. P=2, and each transformed vector is split into four subvectors, i.e. M=4. The corresponding $C^1=(c_1^1,c_2^1,c_3^1,c_4^1)$ and $C^2=(c_1^2,c_2^2\ c_3^2,c_4^2)$ are obtained from the codebooks. The two vectors $\hat{\Phi}^1$ and $\hat{\Phi}^2$ are formed. They are compared with the input vector $X_i$. One of the representative vectors, which yields the lower energy in the error is selected.

Figure 2:
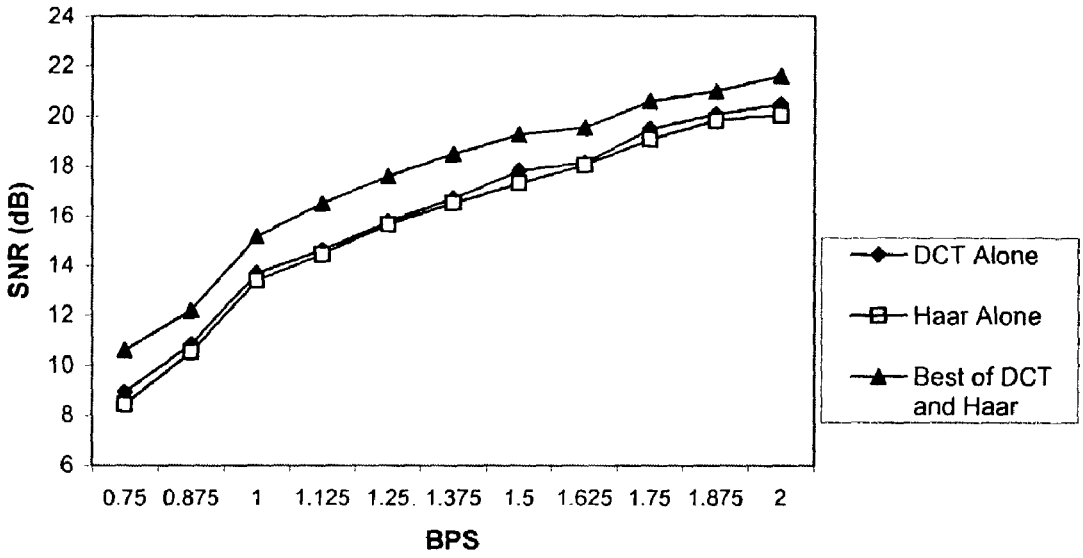
FIG. 2 shows Signal to Noise Ratio (SNR) vs. Bits per Sample (BPS) using three approaches.

In FIG. 2, the performance of the proposed VQMND-W is compared with that of the single transform (DCR or Haar) vector quantizer using energy based vector partitioning. The results indicate that the vector quantizer performance employing two transforms is better than that obtained using a single transform for the same bit rates. From our simulations, confirmed by the sample results given here, a gain in SNR of approximately 1.5 dB is consistently observed for values of BPS from 1.0 to 2.0 when one of the transforms that better represent each signal vector is used as compared to using either one of the two transforms. It is expected that, a higher gain in SNR without any significant addition of overhead can be obtained if more transform domain representations are used.

Figure 3:
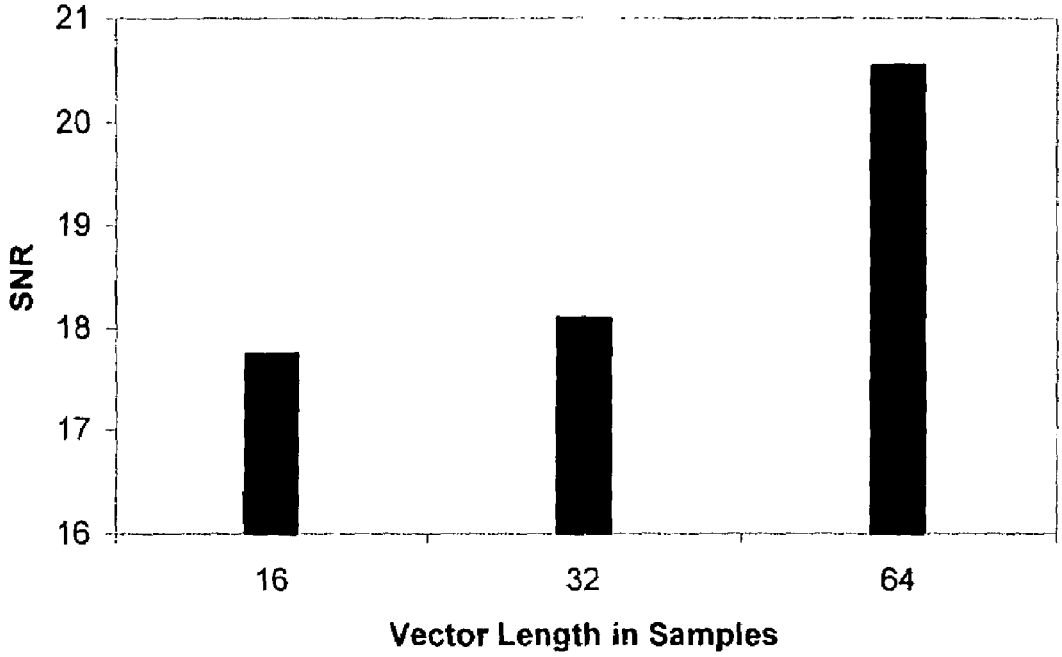
FIG. 3 shows the SNR vs. vector length in samples for 1.5 BPS encoding of the speech sampled at 8000 samples/sec using VQMND-W.
Figure 4:
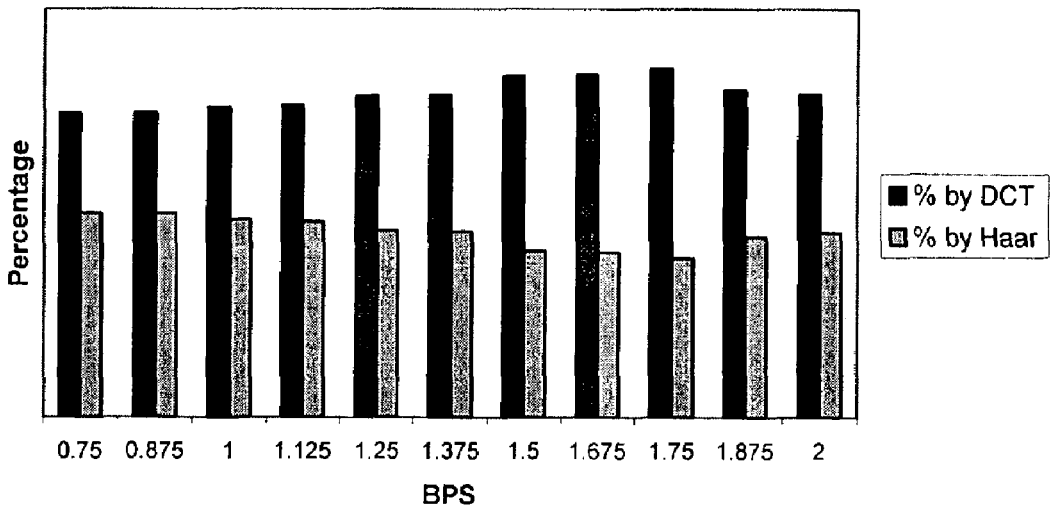
FIG. 4 graphs percentage of vectors that are better represented by DCT and Haar for different BPS and vector lengths of 32 samples.

The performance of the VQMND-W for 1.5 BPS using vector lengths of 16, 32 and 64 is compared in FIG. 3. It is observed that for the same number of BPS, a higher SNR is obtained if longer vectors are formed. This is true for speech signals and other signals provided that the signal remains relatively stationary over the vector length. FIG. 4 shows the percentage distribution of the domain selected as a function of codebook resolution (BPS). The quantizer selects approximately 60% of the representations from the DCT domain codebook and 40% from the HAAR domain codebook. The higher frequency of selection of the DCT domain is expected because the high energy voiced parts of the speech signals are better represented by sinusoidal basis functions.

Figure 5:
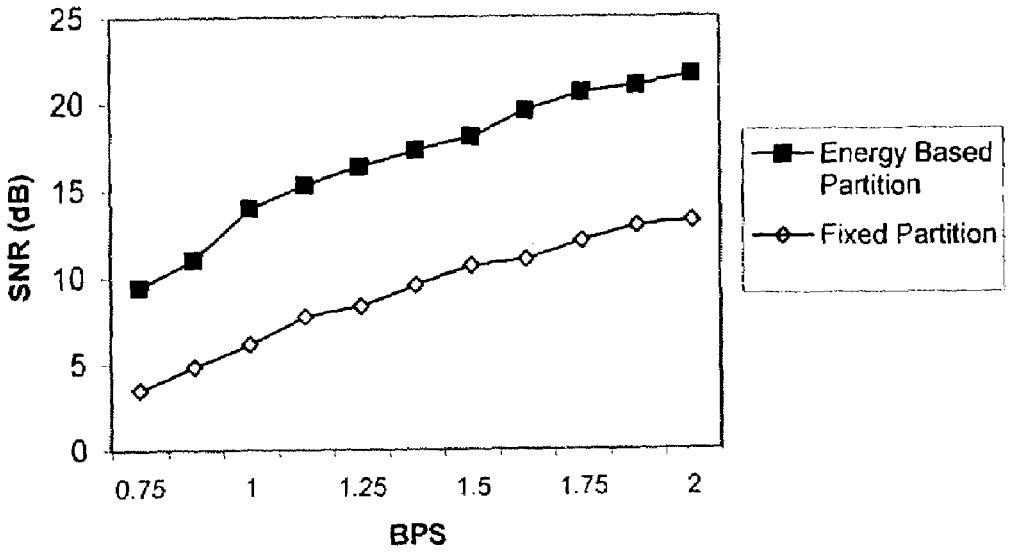
FIG. 5 shows SNR vs. BPS of speech coded using VQMND-W for two cases.
Figures 6A, 6B, 6C:
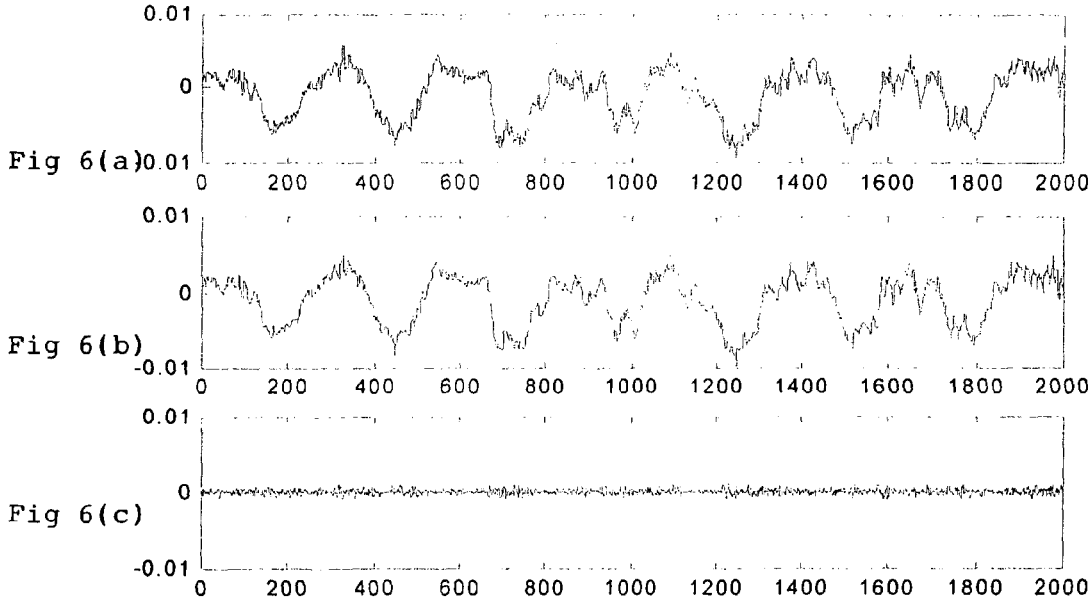
FIG. 6(*a*) shows the Records of input speech sampled at 8000 Samples/sec, and vector lengths of 32 samples.

FIG. 5 shows the comparison of the SNR obtained when the proposed VQMND-W is employed as against a multiple transform vector quantizer with a fixed length vector partitioning. When vectors are partitioned on the basis of energy, shorter subvectors contain coefficients that have higher energy while longer subvectors are made up of coefficients that contain lower values of energy. Equal number of bits is allotted to each of these subvectors since they approximately contain equal amounts of energy. For fixed partitioning, four subvectors, each containing eight consecutive vector samples are used. The improvement in SNR is noted to be significant when an energy-based partitioning is employed.

Figure 8:
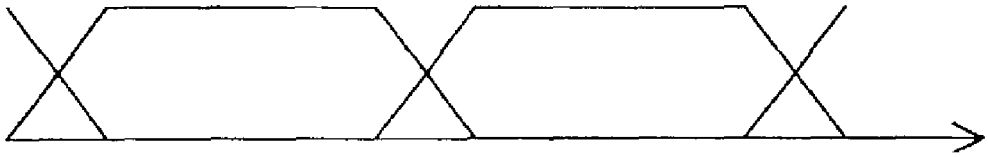
FIGS. 8 (*a*) and (*b*) illustrates the results of the process of Windowing the Signal Bank of Trapezoidal windows of length N, and Structure of a window, respectively.
Figure 8:
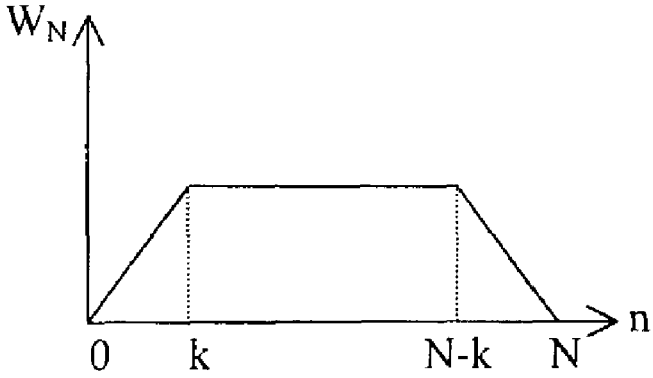

FIG. 8 shows a finite record of the original speech samples, reconstructed signal and error waveform using the proposed VQMND-W scheme at 2 bits/sample, vector length of 32 samples and two transforms: DCT and Haar.

Section 3: VQMND for Model Based Coding of Signals (VQMND-M)

Figure 7:
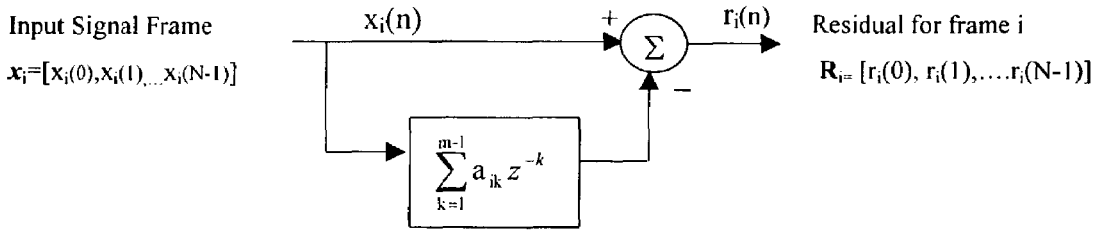
FIG. 7(*a*) and (*b*) shows an LP Model based signal characterization (a) Linear Prediction Analysis and (b) Linear Prediction Synthesis, respectively.
Figure 7:
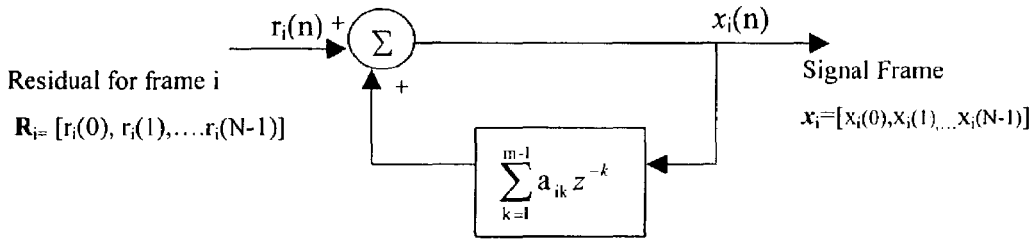

Linear Prediction has been widely used in model based representation of signals. The premise of such representation is that a broadband, spectrally flat excitation, e(n), is processed by an all pole filter to generate the signal. Thus, widely used source-system coding techniques model the signal as the output of an all pole system that is excited by a spectrally white excitation signal. A typical LP source-system signal model is shown in FIG. 7. The coefficients of the all pole autoregressive system are derived by Linear Prediction (LP) analysis, a process that derives a set of moving average (MA) coefficients, $A_i=[a_{i0}, -a_{i1}, -a_{i2}, \ldots, -a_{i(m-1)}]^T$, $a_{i0}=1$, over a frame of signal i. The LP predicts the present signal sample, $x_i$ (n) from m previous values by minimizing the energy in the system output which is referred to as the prediction residual error, $R_i=[r_i(0), r_i(1), \ldots r_i(N-1)]^T$. The frame size N is chosen such that the signal is relatively stationary. Thus $$r_i(n) = x_i(n) - \sum_{k=1}^{m-1} a_{ik} x_i(n-k) \text{ for } n = 0, 1 \ldots N-1 \tag{6}$$

Equivalently, in the z domain, the response of the LP Analysis filter is given by $$A_i(z) = 1 - \sum_{k=1}^{m-1} a_{ik} z^{-k} \tag{7}$$

The LP analysis filter decorrelates the excitation and the impulse response of the all pole synthesis filter to generate the prediction residual $R_i$ that is an estimate of the excitation signal (e(n). In other words, $$r_i(n) \approx e(n)$$

While decoding, the signal $x_i$(n) is synthesized by filtering the excitation, $r_i$(n), by an autoregressive synthesis filter whose pole locations correspond to zeroes of the LP analysis filter. The response of the synthesis filter is given by $$H_i(z) = \frac{1}{1 - \sum_{k=1}^{m-1} a_{ik} z^{-k}} \tag{8}$$

The sinusoidal frequency response $H_i$ (f) of the synthesis filter is obtained by evaluating (8) over the unit circle in the z plane. Thus, $$H_i(f) = \frac{1}{1 - \sum_{k=1}^{m-1} a_{ik} \exp(-j2\pi kf)} \tag{9}$$

for $z=\exp(j2\pi f)$ where f is normalized with respect to the sampling frequency. Excellent applications of Linear Prediction in Signal processing have been widely reported. A tutorial review of Linear Prediction analysis is given in [see Makhoul J., "Linear Prediction: A tutorial Review", Proc. of the IEEE, vol. 63, No.4, pp 561-580, April 1975.].

In general, LP coefficients are not directly encoded using vector quantization. Other equivalent representations of the LP coefficients such as, Line Spectral Pairs [see Itakura F., "Line Spectrum representation of Linear Predictive Coefficients of speech signals," Journal of the Acous. Soc. of Amer., Vol.57, p. 535(a), p. s35 (A), 1975.], Log Area Ratios [see Viswanathan R., and Makhoul J., "Quantization properties of transmission coefficients in Linear Predictive systems," IEEE Trans. on Acoust., Speech and Signal Processing, vol. ASSP-23, pp. 309-321, June 1975.] or Arc sine reflection coefficients [see Gray, Jr A. H., and Markel J. D., "Quantization and bit allocation in Speech Processing", IEEE Trans. on Acoust., Speech and Signal Processing, vol. ASSP-24, pp 459-473, December 1976] are used.

In this section, a novel LP model based coding technique, Vector Quantizer in Multiple Nonorthogonal Domain—model based codec (VQMND-M) is presented where multiple nonorthgonal domain representations of LP coefficients and the prediction residuals are used in conjunction with vector quantization. The performances of the proposed VQMND-M technique and the existing vector quantizers employing single domain representation are compared. Sample results confirm the improved performance of the proposed method in terms of reconstruction quality, for the same bit rate, at the cost of a modest increase in computation.

3.1 Encoding the LP Coefficients of the VQMND-M

Transparent coding of the LP coefficients requires that there should be no objectionable distortion in the reconstructed synthesized signal due to quantization errors in encoding the LP coefficients [see Paliwal K. K., and Atal B. S., "Efficient Vector Quantization of LPC Coefficients at 24 Bits/Frame", IEEE Trans. Speech and Audio Processing, Vol. 1, pp. 3-24, January 1993.]. In this contribution, vector quantization of the LP coefficients in multiple domains, designated VQMND-M, is proposed. For efficient encoding of the LP coefficient information, a large number of bits has to be allocated for each vector. This causes the codebook size to be prohibitively large. This problem is addressed by using a sub optimal split or partitioned vector quantization technique [see Gersho A., and Gray R. M., "Vector Quantization and Signal Compression," Kluwer Academic Publishers, 1991].

In the training mode, the codebooks are designed. For each representation of the LP coefficients, the corresponding coefficient vector is appropriately split into subvectors (subbands). An equal number of bits is assigned to each subvector. A codebook is then designed for each subvector of each representation. In the running mode, the coder selects codes for LP coefficients, from the domain that represents the coefficients with the least distortion in the reconstructed synthesis filter response.

3.1.1 LP Coefficient Codebook Formation: Training Mode

The input signal X(n) is first windowed appropriately. Although, in this invention, the technique is illustrated using a bank of overlapping trapezoidal windows, $W_N$, FIG. 8, other windows may be employed. Thus, the $i^{th}$ frame of the windowed signal, $x_i$(n), is given by, $$x_i(n) = W_N(n) X(i(N-k)+n) \quad n=0, 1 \ldots N-1$$

Where $$W_N(n) = \begin{cases} \frac{n}{k} & \text{for } 0 \le n \le k \\ 1 & \text{for } k < n \le N-k-1 \\ \left(\frac{N-n}{k}\right) & \text{for } N-k-1 < n \le N-1 \end{cases} \quad (10)$$

k represents the length of overlap.

The LP coefficients, $A_i=[1, -a_{i1}, -a_{i2}, \ldots, -a_{i(m-1)}]$, are obtained from each signal frame, $x_i$, by using one of the available LP Analysis methods, [see Makhoul J., "Linear Prediction: A tutorial Review", *Proc. of the IEEE,* vol 63, No. 4, pp 561-580, April 1975]. The LP coefficients are then transformed and represented in multiple equivalent nonorthogonal domains. Thus, for the $i^{th}$ signal frame, $A_i$ is represented in K nonorthgonal domains and the representations are designated $\Phi_i^1, \Phi_i^2, \ldots, \Phi_i^K$, where each $\Phi_i^j$ is an m×1 column vector, containing the representation of the LP coefficients in domain j. Then, each $\Phi_i^j$, for j=1, 2, . . . , K, is split into L subvectors such that $\Phi_i^j=[\Phi_{i1}^j, \Phi_{i2}^j, \ldots, \Phi_{iL}^j]$. Although the lengths of the individual subvectors may vary according to case specific criteria, the sum of lengths of these subvectors equals m. The subvectors obtained for all training vectors in each domain are collected and clustered using a suitable vector-clustering algorithm such as the k-means [see Linde Y., Buzo A., Gray R., "An Algorithm for Vector Quantizer Design," IEEE Trans. Communication, COM-28: pp 702-710, 1980.]. Thus, a codebook is generated for each subvector of each domain of representation of the LP coefficients. In the $j^{th}$ domain of representation, the codebooks designed are designated $C_1^j, C_2^j \ldots, C_L^j$. The accuracy of the codebooks is further enhanced using an adaptive technique.

Section 4

3.1.2 LP Coefficient Encoding: Running Mode

In this section, the encoding procedure for the LP coefficient vector, including the selection of appropriate domain of representation is described. The schematic of the overall LP Coefficient encoding process utilizing linear prediction analysis from the input signal frame 92, is shown in FIG. 9.

Figure 9:
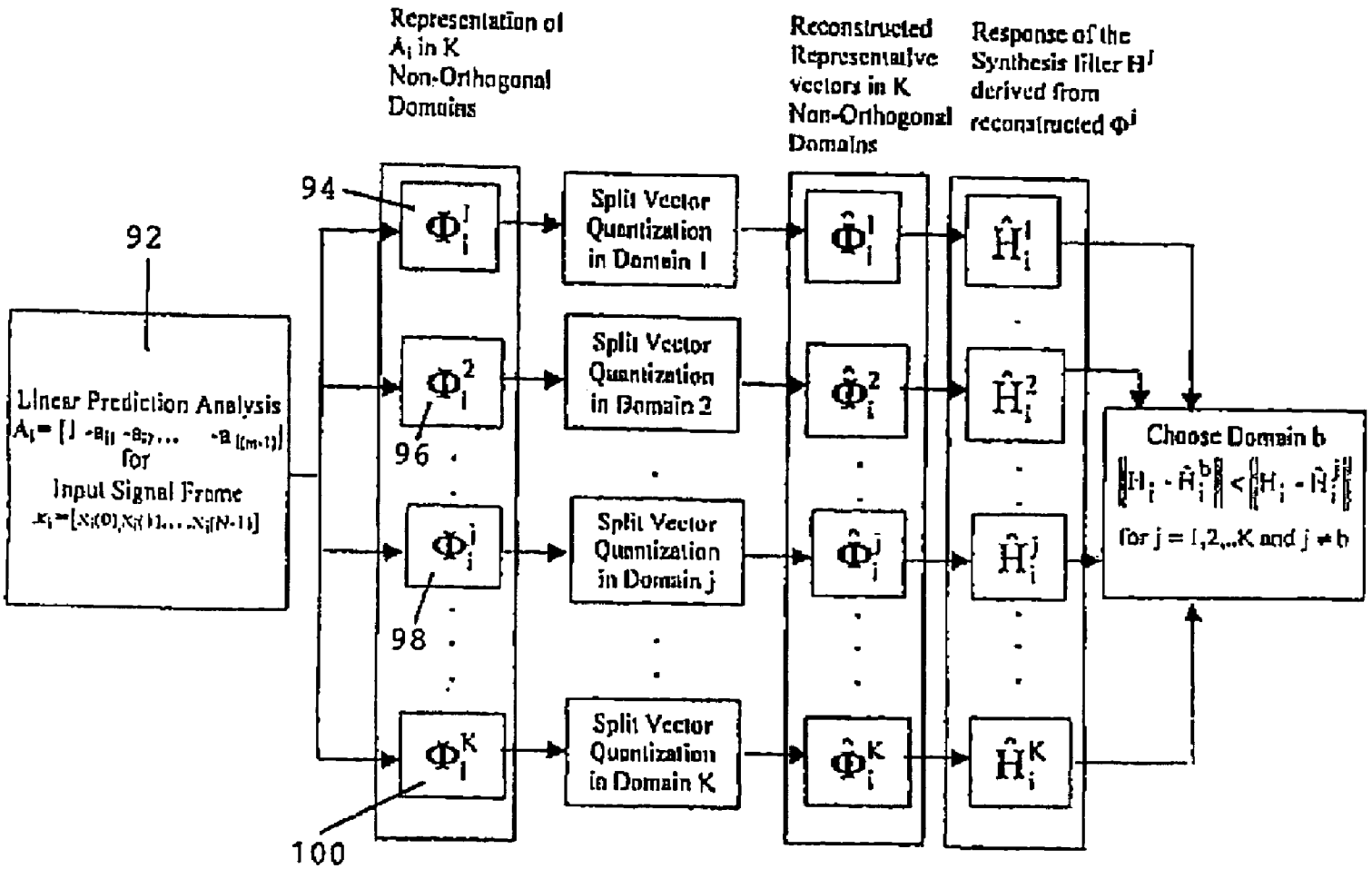
FIG. 9 shows the LP Coefficient Encoding Process wherein $H_i$ is the unquantized Synthesis filter response for the $i^{th}$ signal frame.
Figure 10:
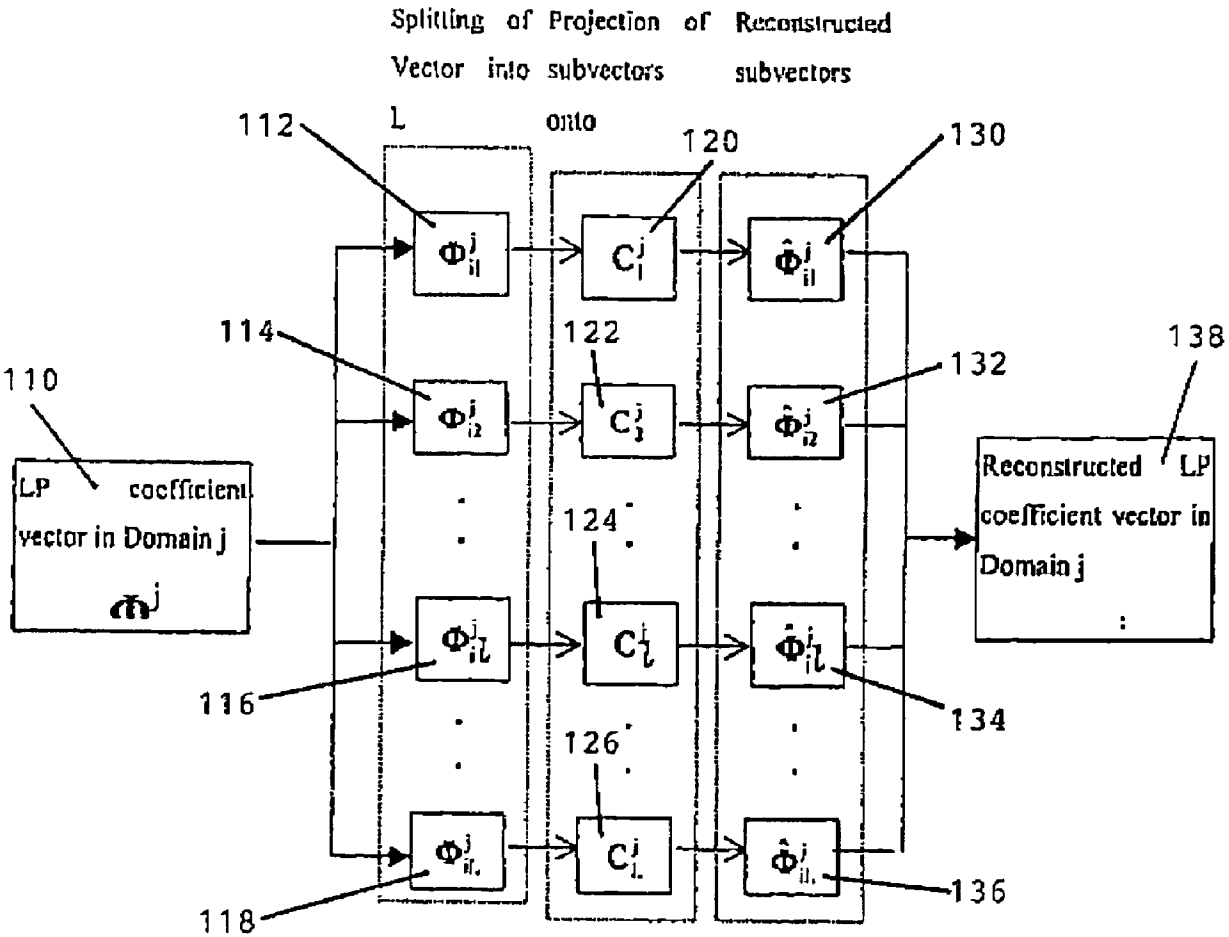
FIG. 10 shows a Split Vector Quantization of LP Coefficient vector in domain j.

The block diagram, FIG. 10, describes the split vector quantization of $\Phi_i^j$ utilized in the encoding process of FIG. 9 at 94, 96, 98, and 100. The quantized representations of $\Phi_i^j$ 110 in the domain j, is obtained by projecting each subvector $\Phi_{iL}^i$, l=1 112, 2 114, . . . L116, L 118, onto the corresponding codebook $C_L^i$, l=1 120, 2 122, . . . L124, L 126, and then concatenating the corresponding subvectors to obtain $\hat{\Phi}_i^j$l where L=1 130, 2 132, L134 . . . L 136. The quantized LP coefficient representation in multiple domains is designated as $\hat{\Phi}_i^1, \hat{\Phi}_i^2, \ldots \hat{\Phi}_i^K$. Each of these representations can then be independently transformed back to the corresponding LP coefficient representation. Thus, for the $i^{th}$ frame of the signal, we have K redundant LP coefficient representations, designated as $\hat{A}_i^1, \hat{A}_i^2, \ldots, \hat{A}_i^K$ obtained from $\hat{\Phi}_i^1, \Phi_i^2, \ldots, \hat{\Phi}_i^K \ldots$, respectively. It must be noted that, each $\hat{A}_i^j$ contains m reconstructed LP coefficients $[1, -\hat{a}_{i1}^j, -\hat{a}_{i2}^j, \ldots, -\hat{a}_{i(m-1)}^j]^T$. The encoder then chooses one of the K representations to encode the LP coefficients of the $i^{th}$ frame that gives the minimum error according to an appropriate criterion. For illustration in this contribution, the domain chosen b is such that $$\|H_i(f)-\hat{H}_i^b(f)\|^2 < \|H_i(f)-\hat{H}_i^j(f)\|^2,\ 0 \le f \le 0.5 \text{ for } j=1,2,\ldots K \text{ and } j \ne b \quad (11)$$

where $$\hat{H}_i^j(f) = \frac{1}{1-\hat{a}_{i1}^j \exp(-j2\pi f) - \hat{a}_{i2}^j \exp(-j2\pi 2f) - \ldots\ \hat{a}_{i(m-1)}^j \exp(-j2\pi(m-1)f)} \quad (11)$$

Here ||.|| represents the Euclidian norm. The index, b, of the chosen domain, is appended to the concatenation of the codewords corresponding to each subvector obtained from codebooks $C_1^b, C_2^b, \ldots, C_L^b$, in domain b, respectively, and provides the reconstructed LP coefficient vector in domain j 138.

3.2 Prediction Residual Coding

In some applications, such as speech, LP coefficients are considered approximately stationary over the duration of one window, while the LP residuals are considered stationary over equal length segmented portions of the window. This situation is developed here to be consistent with the speech application presented later. Over each relatively stationary segment of the residual, appropriate linear transform domain representations compact the prediction residual information in fewer coefficients than time/space domain representation. This implies that the distribution of energy among the various transform coefficients is highly skewed and few transform coefficients represent most of the energy in the prediction residuals. This fact is exploited in split vector quantization, also referred to as partitioned vector quantization, where the transform coefficients of the windowed residual vector are partitioned into subvectors. Each subvector is separately represented. This partitioning enables processing of vectors with higher dimensions in contrast with time/space direct vector quantization.

In this contribution, in a manner similar to the encoding procedure for LP coefficients, each segment over which the prediction residual is considered stationary is simultaneously projected into multiple nonorthogonal transform domains. Each segment of the prediction residuals is represented using split vector quantization in a domain that best represents the prediction residuals as measured by the energy in the error between the original and the quantized residual segment.

3.3 Error Compensated Prediction Residuals

Instead of obtaining the prediction residuals, $R_i$, corresponding to the $i^{th}$ signal frame $x_i$, from the unquantized LP coefficients $A_i$ as described by (6), the error compensated prediction residuals, $CR_i=[cr_i(0), cr_i(1), \ldots, cr_i(N-1)]^T$ are obtained by filtering $x_i$ by the quantized LP analysis filter $\hat{A}_i^b$. The choice of b has been described in the previous section. Thus, $$cr_i(n) = x_i(n) - \sum_{p=1}^{m-1} \hat{a}_{ip}^b x_i(n-p) \text{ for } n = 0, 1, \ldots N-1 \quad (12)$$

Since the residues are obtained by filtering the signal frame using the quantized LP coefficients, $CR_i$ accounts for the LP coefficient quantization error.

3.3.1 Error Compensated Residual Codebook Generation: Training Mode

As mentioned earlier, $CR_i$ is divided into M segments $CR_{i1}, CR_{i2}, \ldots CR_{iM}$, each containing N/M residuals from $CR_i$. Each segment is independently projected in P nonorthogonal transform domains. Let the segment $CR_{ik}$, k=1, 2, . . . , M, be designated by $\Psi_{ik}^{j}$ in the $j^{th}$ transform domain, where j=1, 2, . . . , P, FIG. 11. Each transform domain segment representation, $\Psi_{ik}^{j}$, is split into Q subvectors such that $\Psi_{ik}^{j}=[\Psi_{ik1}^{j}, \Psi_{ik,z}^{j}, \ldots, \Psi_{ik,Q}^{j}]^T$. It must be noted that the sjm of lengths of $\Psi_{ik,q}^{j}$, for q=1,2, . . . , Q, is N/M. A codebook, $C_{k,q}^{j}$, is designed by clustering the training vector ensemble formed by collecting the corresponding $\Psi_{ik,q}^{j}$ from all signal frames for each j, k and q. Again, considerable improvement in the codebook accuracy is achieved using the adaptive technique.

Section 4

3.3.2 Error Compensated Residual Encoding: Running Mode

In this section, the coding of $CR_i$, including the selection of the appropriate domain of representation is discussed. The quantized representation, $\hat{\Psi}_{ik}^{j}$, of each transformed segment $\Psi_{ik}^{j}$, k=1,2 . . . , M, of the signal frame i, is obtained by concatenating the representative subvectors $\hat{\Psi}_{ik,q}^{j}$ of the $k^{th}$ segment obtained from the cookbook $C_{k,q}^{j}$. Now, the encoder chooses the transform domain d for the $k^{th}$ segment, such that $$\|\Psi_{ik}^{d}-\hat{\Psi}_{ik}^{d}\|^2<\|\Psi_{ik}^{j}-\hat{\Psi}_{ik}^{j}\|^2 \text{ for } j=1,2, \ldots, P, \text{ and } j\neq d \tag{13}$$

The reconstructed residual vector segment $C\hat{R}_{ik}$ is obtained by the inverse d transformation of $\hat{\Psi}_{ik}^{d}$. These segments are then concatenated to form the reconstructed residual $C\hat{R}_i$ corresponding to frame i.

3.3.3 Signal Synthesis from Reconstructed Coefficients and Residuals

At the decoder, the signal frame is reconstructed by emulating the signal generation model. The quantized LP Coefficients $\hat{A}_i^{b}$, for the frame i, are used to design the all pole synthesis filter whose transfer function is $$\frac{1}{\hat{A}_i^{b}(z)}.$$

The filter is then excited by the reconstructed residual $C\hat{R}_i=[c\hat{r}_i(0), c\hat{r}_i(1), \ldots, c\hat{r}_i(N-1)]^T$ to obtain the synthesized signal frame $x'_i(n)$.

The synthesis process is defined by the difference equation, $$x'_i(n) = c\hat{r}_i(n) + \sum_{p=1}^{m-1} \hat{a}_{ik} x'_i(n-p) \text{ for } n = 0, 1, \ldots, N-1 \tag{14}$$

Concatenation of the signal frames $x'_i(n)$ with addition of the corresponding components of the regions of overlap between adjacent window frames yields the reconstructed speech signal, X', at the receiver.

3.4. Adaptive Codebook Design for Nonorthgonal Domain Representations

In the multiple nonorthogonal domain vector quantization techniques described in the previous sections, codebooks in a given domain are used to encode only those vectors that are better represented in that domain. In this section, an adaptive codebook accuracy enhancement algorithm is developed where the codebooks in a given domain are improved by redesigning them using only those training vectors that are better represented in that domain. A detailed description of the adaptive codebook accuracy enhancement algorithm is presented in Section 4.

For each signal frame, the domain of representation of LP coefficients and the prediction residuals are chosen according to (11) and (13) respectively. Each set of codebooks in a given domain of representation for the LP coefficients $C_1^{j}, C_2^{j}, \ldots, C_L^{j}$, for j=1,2 . . . P, and for the prediction residuals, $C_{k,q}^{j}$, for k=1,2 . . . , M and q=1,2 . . . Q, are then re-designed using a modified training vector ensemble formed using only those training vectors that are better represented in that domain, i.e., those vectors that selected that particular domain of representation. During each iteration of the algorithm, the clustering procedure is initialized with the centroids from the previous iteration. The algorithm is repeated until a certain performance objective is achieved. In the simulation results presented in this contribution, it is observed that the performance of the VQMND-M, as measured by the overall Signal to Noise Ratio (17), obtained using the training set of vectors increases significantly during the first three to four iterations for different codebook sizes. No significant performance improvement is observed after the third or fourth iteration and the adaptive algorithm is terminated.

3.5. Application of the Proposed Technique to Speech Signals

In this section, a Vector Quantizer in Multiple Nonorthogonal Domains for Model based Coding of speech (VQMND-Ms) is developed and evaluated. Several representations of the LP coefficients, and the residuals were considered and evaluated for this application. Sample results are given, and the representations selected are identified. The Log Area Ratios (LAR), and the Line Spectral Pairs (LSP) representations were used for the LP coefficient encoding since they guarantee the stability of the speech synthesizer. The DCT and Haar transform domains were used to represent the residuals since these were previously shown to augment each other in representing narrowband and broadband signals [see Berg, A. P. , and Mikhael, W. B., "A survey of mixed transform techniques for speech and image coding," Proc. of the 1999 IEEE International Symposium Circ. and Syst., ISCAS '99, vol.4, 1999].

Although one-dimensional speech signals are used to demonstrate the improved performance of the proposed method, the technique developed can be easily extended to several other one and multidimensional signal classes.

3.5.1 Linear Prediction Model Based Speech Coding

The goal of speech coding is to represent the speech signals with a minimum number of bits for a predetermined perceptual quality. While speech waveforms can be efficiently represented at medium bit rates of 8-16 kbps using non-speech specific coding techniques, speech coding at rates below 8 kbps is achieved using a LP model based approach [see Spanias A., "Speech Coding: A Tutorial Review," Proc. of the IEEE, vol. 82, No 10. pp. 1541-1585, October 1994.] Low bitrate coding for speech signals often employs parametric modeling of the human speech production mechanism to efficiently encode the short time spectral envelope of the speech signal. Typically, a 10 tap LP analysis filter is derived for a stationary segment of the speech signal (10-20 ms duration) that contains 80 to 160 samples for 8 kHz sampling rate. The perceptual quality of the reconstructed speech at the decoder largely depends on the accuracy with which the LP coefficients are encoded. Transparent coding of LP coefficients requires that there should be no audible distortion in the reconstructed speech due to error in encoding the LP coefficients [see Paliwal K. K., and Atal B. S., "Efficient Vector Quantization of LPC Coefficients at 24 Bits/Frame", IEEE Trans. Speech and Audio Processing, Vol. 1, pp. 3-24, January 1993.]. Often, LP coefficient encoding involves vector quantization of equivalent representations of LP coefficients such as Line Spectral Pairs (LSP), and Log Area Ratios (LAR). For the sake of completeness, the following Sections, 5.2 and 5.3, briefly review these two representations. The notation $\Phi_i^1=[\Phi_{i1}^1, \Phi_{i2}^1, \ldots, \Phi_{im}^1]^T$ is used to denote the m LSP and $\Phi_i^2=[\Phi_{i1}^2, \Phi_{i2}^2, \ldots, \Phi_{im}^2]^T$ is used to denote the m LAR obtained from the LP coefficients $A_i$ of the $i^{th}$ speech frame.

3.5.2 Line Spectral Pairs and Line Spectral Frequencies

Line Spectral Pairs (LSP) representation of LP coefficients was first introduced by Itakura. The properties of the LSP enable encoding the LP coefficients such that the reconstructed synthesis filter is BIBO stable [see Soong F. K., and Juang B. H., "Optimal Quantization of LSP Coefficients", IEEE Trans. Speech and Audio Processing, Vol 1, No. 1, pp. 15-23, January 1993.].

For a LP analysis filter with coefficients $A_i$, two polynomials, a symmetric $\Gamma_i(z)$ and an antisymmetric $A_i(z)$ may be defined, such that $$\Gamma_i(z)=A_i(z)+z^{-(m-1)}A_i(z^{-1})$$

$$\Lambda_i(z)=A_i(z)-z^{-(m+1)}A_i(z^{-1}) \tag{15}$$

The m conjugate roots, $\Phi_{ip}^1$, p=1,2 . . . , m, of the above polynomials are referred to as the Line Spectral Pairs (LSP). Equation (11) can be rewritten as, $$\Gamma_i(z)=\prod_{p=1}^{m/2}(1+z)(1-2\Phi_{i(2p-1)}^1 z^{-1}+z^{-2}) \tag{16}$$

$$\Lambda_i(z)=\prod_{p=1}^{m/2}(1-z)(1-2\Phi_{i(2p)}^1 z^{-1}+z^{-2})$$

The $p^{th}$ element of $\Phi_i^1$ is $\Phi_{ip}^1$ p=1,2 . . . m. Thus, the LP coefficients and the LSPs are related to each other through nonlinear reversible transformations. Also, $$\Phi_{ip}^1=\cos(\omega_p) \tag{17}$$

The coefficients $\omega_1, \omega_2, \ldots, \omega_m$ are called the Line Spectral Frequencies (LSF). The LSP corresponding to $\Gamma_i(z)$ and $A_i(z)$ are interlaced and hence the LSF follow the ordering property of $0<\omega_1<\omega_2<\ldots<\omega_m<\pi$.

It has been proven, [see Sangamura N., and Itakura. F., "Speech data compression by LSP Speech analysis and Synthesis technique," IEEE Trans., Vol. J64 A, no.8, pp 599-605, August 1981 (in Japanese) and Soong F. K., and Juang B. H., "Line Spectral Pair and Speech Data Compression," in Proc. of ICASSP-85, pp. 1.10.1-1.10.4, 1984.] that all LSP, $\Phi_{ip}^1$, p=1,2 . . . m, lie on the unit circle. This implies that after quantization, if the LSP corresponding to $\Gamma_i(z)$ and $A_i(z)$ continue to be interlaced and lie on a unit circle, the LP analysis filter derived from the quantized LSP will have all its zeroes within the unit circle. In other words, the synthesis filter, whose poles coincide with the zeroes of the analysis filter, will be BIBO stable.

3.5.3 Log Area Ratios

The LP coefficients, $A_i$ for the $i^{th}$ speech frame $x_i(n)$, for n=0,1, . . . , N−1 , are derived by solving m simultaneous linear equations given by $$r_{xx}(p)-\sum_{k=1}^{m-1}a_{ik}r_{xx}(p-i)=0 \text{ for } p=1,2,\ldots m. \tag{18}$$

where $r_{xx}(p)=E[x_i(n+p)x_i(p)]$ is the autocorrelation of the speech segment, and E [.]

is the expectation operator.

The solution of (14) is obtained using the recursive Levinson-Durbin [see Durbin J., "The Filtering of Time Series Model," Rev. Institute of International Statistics, vol. 28, pp.233-244, 1960.] algorithm that involves an update coefficient, called the reflection coefficient, $\kappa_p$, for p=1, 2 . . . , m. The reflection coefficients obey the condition $|\kappa_p|<1$ for p=1,2 . . ., m. The reflection coefficients are an ordered set of coefficients, and if coded within the limits of −1 and 1, can ensure the stability of the synthesis filter. Alternatively, these reflection coefficients can be transformed into log area ratios given by, $$\Phi_{ip}^2=\log\left\{\frac{1+\kappa_p}{1-\kappa_p}\right\} \text{ for } p=1,2,\ldots m. \tag{19}$$

A quantization error in encoding $\Phi_i^2$, $\Phi_i^2=[\Phi_{i1}^2, \Phi_{i2}^2, \ldots, \Phi_{im}^2]$, maintains the condition $|\kappa_p|<1$ and thus ensures that the poles of the reconstructed synthesis filter lie within the unit circle. It must be noted that the superscript 2 is used to denote the representation of the LP coefficients as log area ratios.

3.5.4 Performance Evaluation of the Proposed VQMND-Ms

Figure 11:
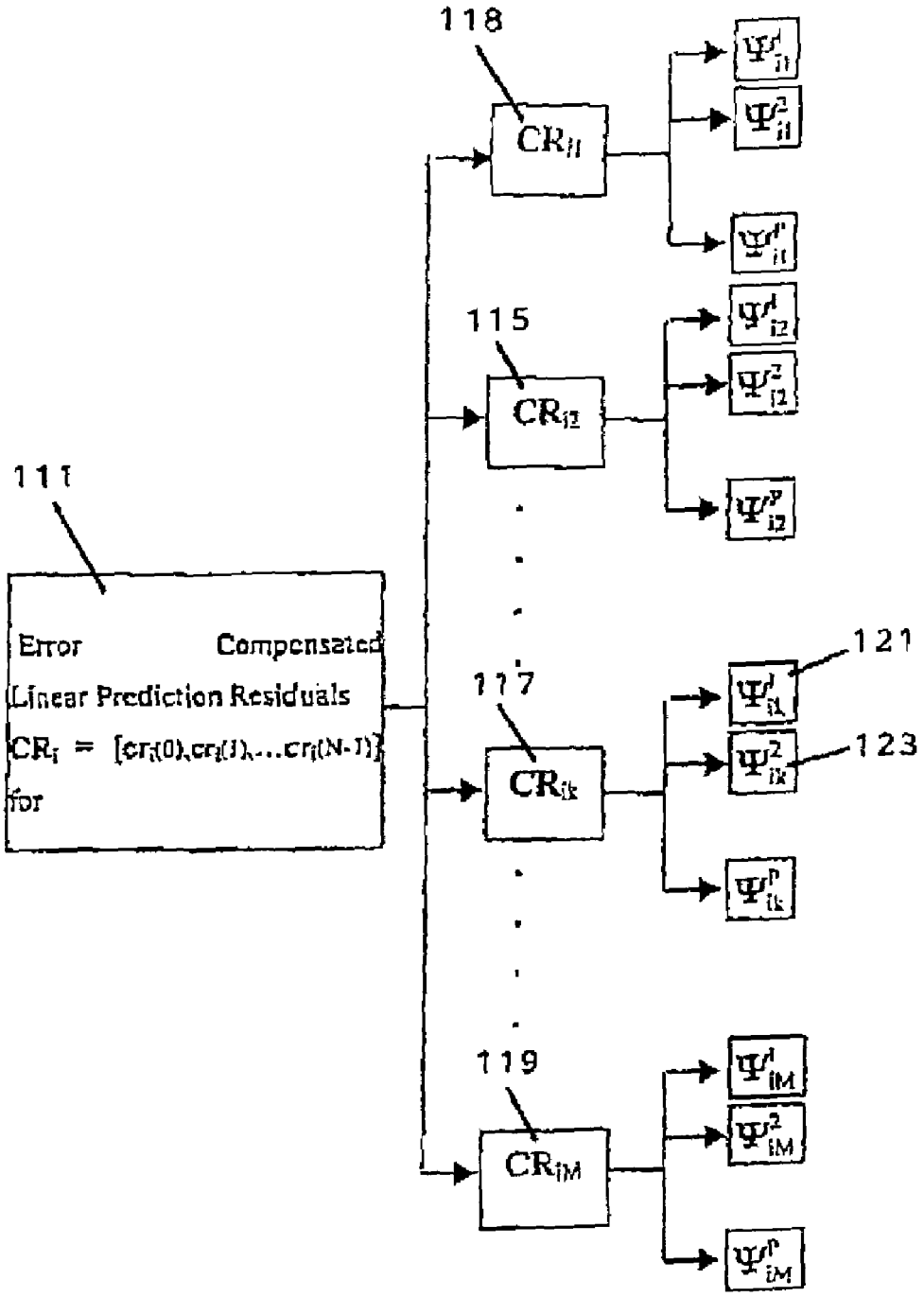
FIG. 11 shows P multiple transform domain representations for each of the M segments of the residuals, for the $i^{th}$ input signal frame.

To demonstrate the performance of the proposed VQMND-Ms, speech signals sampled at 8 KHz are chosen and refer to FIG. 11. The window length, N, is selected to be 128 that represents 16 msec of the speech signal. Ten LP coefficients are derived from each speech frame, i.e., m=10. As mentioned earlier, two equivalent nonorthogonal representations of the LP Coefficients, Log Area Ratios (LAR), and Line Spectral Pairs (LSP) are used, i.e., K=2. The vector formed in each domain of representation of the LP coefficients is then split into two subvectors, i.e., L=2. The error compensated prediction residuals, $CR_i$ 111, for the $i^{th}$ frame are split into four segments $CR_{i1}$ 113, $CR_{i2}$ 115, $CR_{i6}$ 117, $CR_{iM}$ 119 each containing 32 residual samples. Each segment is transformed into two linear transform domain representations, DCT and Haar. Thus P=2 and $\Psi_{ik}^1$ 121 and $\Psi_{ik}^2$ 123 represent the DCT and Haar coefficient vector of the $k^{th}$ subvector of the $i^{th}$ segment. Each vector, $\Psi_{ik}^j$, in each domain is now split into four subvectors corresponding to Q=4. Thus $\Psi_{ik}^j$ is split into $[\Psi_{ik,1}^j, \Psi_{ik,2}^j, \Psi_{ik,3}^j, \Psi_{ik,4}^j]$.

The training vector ensemble for the design of the LP Coefficient codebooks $C_1^j, C_2^j, \ldots, C_l^j$, for j=1,2 . . . P, and the residual codebooks $C_{k,q}^j$, for k=1,2 . . . , M and q=1, 2 . . . ,Q, are formed from a long duration recording (3 minutes) of a speech signal. These codebooks are iteratively improved using the algorithm described in Section 4.

The performance of the VQMND-Ms is evaluated for recordings of speech signals from different sources. The effect of quantization of LP coefficients on the response of the synthesis filter is studied in terms of the Normalized Energy in the Error (NEE) obtained as $$NEE(\text{dB}) = 10\log_{10}\left[\frac{\sum_i \|H_i(f) - \hat{H}_i^b(f)\|^2}{\sum_i \|H_i(f)\|^2}\right] \tag{20}$$

Figure 12:
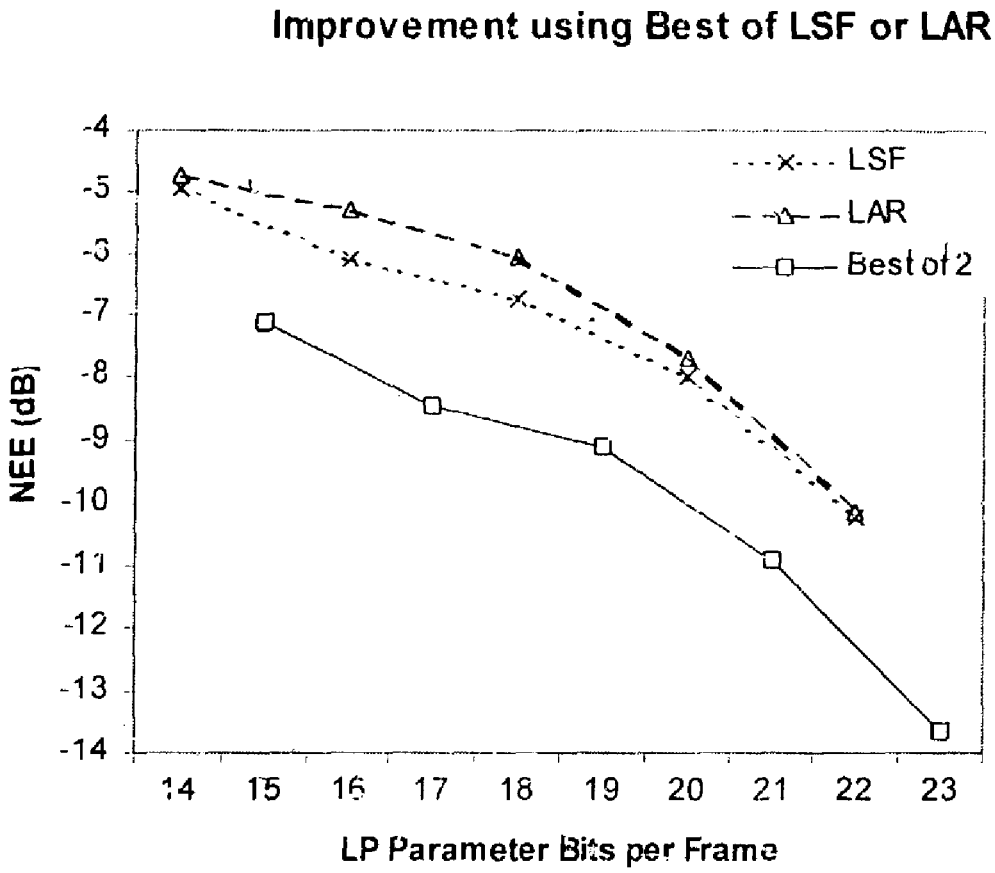
FIG. 12 graphs three cases of normalized energy in error (NEE) in the reconstructed synthesis filter vs. the number of bits per frame allotted for coding the LP coefficients.

The plot of NEE as a function of the number of bits per frame to encode the LP coefficients, for single domain representation of LP coefficients as well as the proposed VQMND-Ms is given in FIG. 12. The values of the NEE for the proposed codec is plotted including the additional bit required in identifying the domain (LSP or LAR) used for the representation of the coefficients of each frame. It is observed that the NEE is significantly lower for the same number of bits per frame, when the proposed method is employed for encoding the LP coefficients as compared to using the single domain representation approach.

Figure 13:
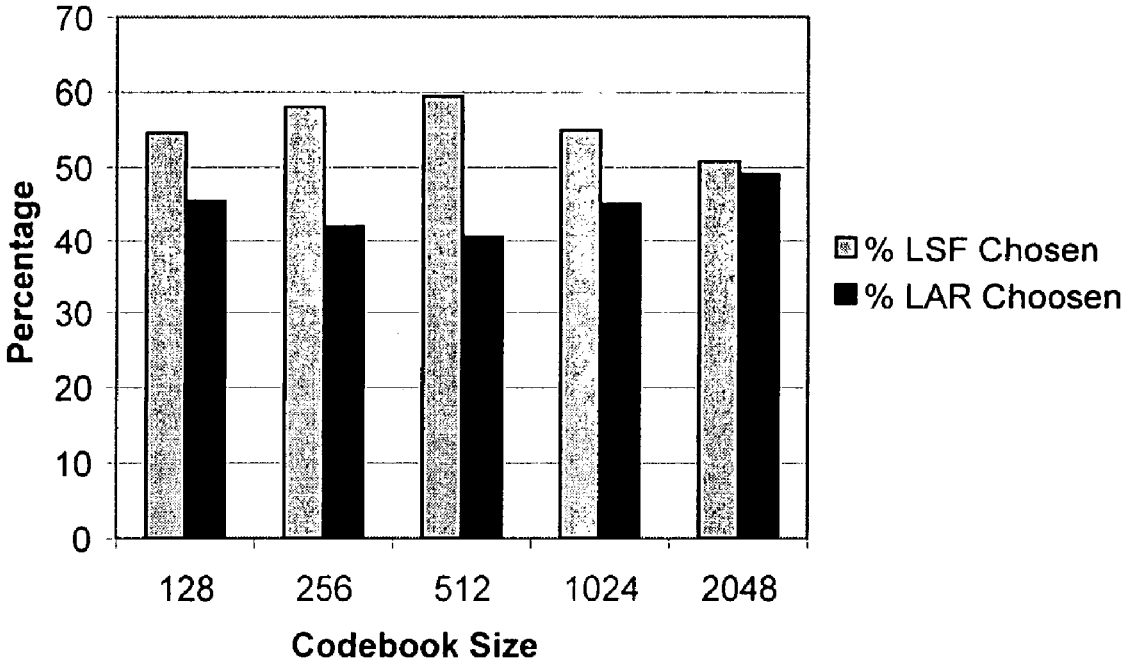
FIG. 13 graphs percentage of vectors in the running mode for different codebook sizes.

FIG. 13. compares the percentage of the LP coefficient vectors, in the running mode, that are better represented in the LSP domain with the percentage that is better represented in the LAR domain. Improved performance of the proposed VQMND-Ms technique as compared to single domain representation approach indicates that both the domains were participating in enhancing the performance of the system.

The performance of the overall coding system is evaluated on the basis of the quality of the synthesized speech at the decoder. This performance is quantified in terms of the signal to noise ratio (SNR) calculated from $$SNR(\text{dB}) = 10\log_{10}\left[\frac{\sum_n (X(n))^2}{\sum_n (X(n) - X'(n))^2}\right] \tag{21}$$

where X(n) is the original speech signal and X'(n) is the reconstructed signal and n is (21) represents the sample index in the speech record.

The overall number of bits per sample (bps) is calculated by dividing the total number of bits used per frame to encode both LP coefficients and the residuals N-k. Different combinations of resolutions for the LP coefficient codebooks and the prediction residual codebook were used to evaluate the performance of the proposed encoder.

Figure 14:
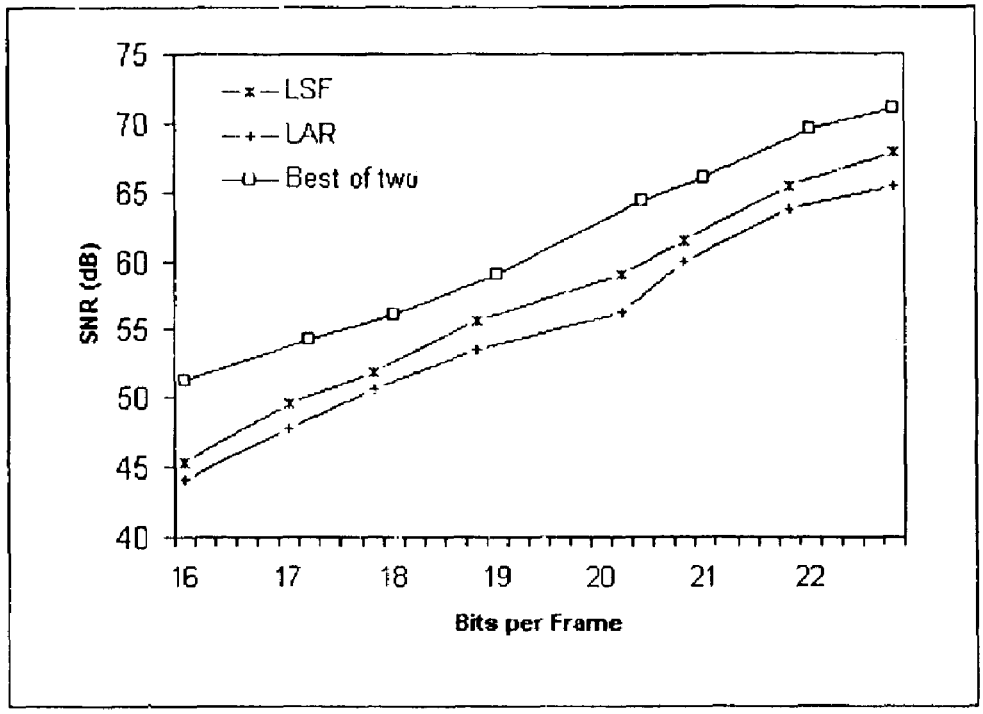
FIG. 14(*a*) shows SNR vs. bits per frame for reconstruction of signal shown in FIG. 15.
Figure 14:
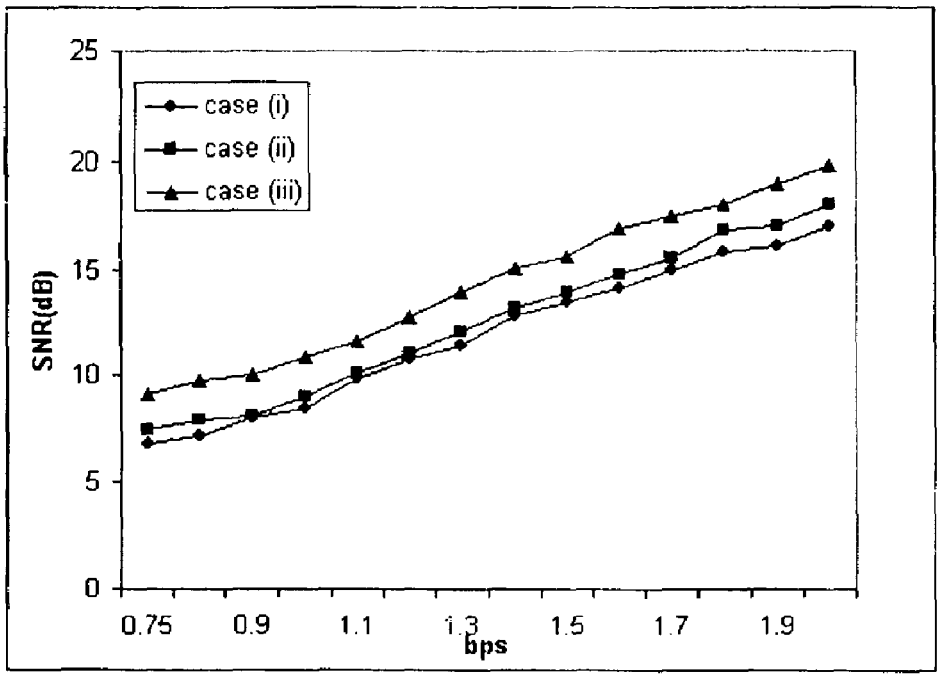
Figures 15A, 15B, 15C:
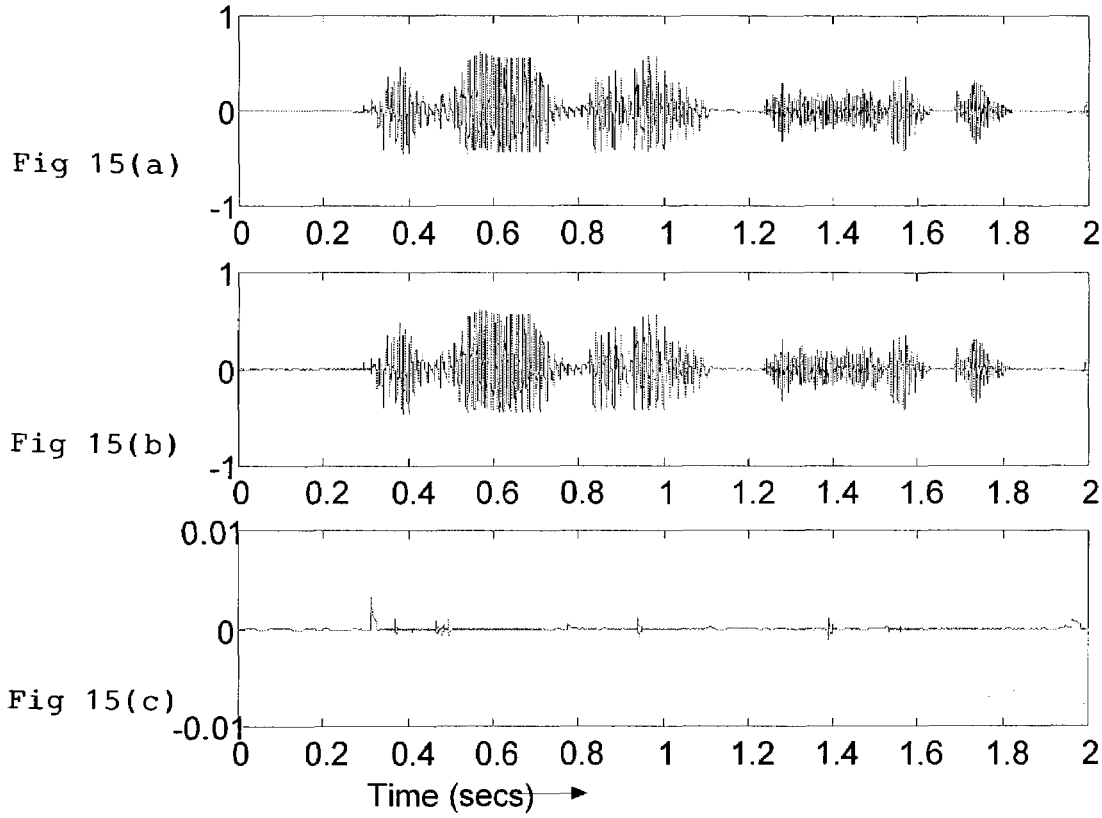
FIGS. 15 (*a*), (*b*), and (*c*) shows original speech record, reconstructed speech record and reconstruction error respectively using the proposed VQMND-Ms at 1 bps vs. time (secs).
Figure 16A:
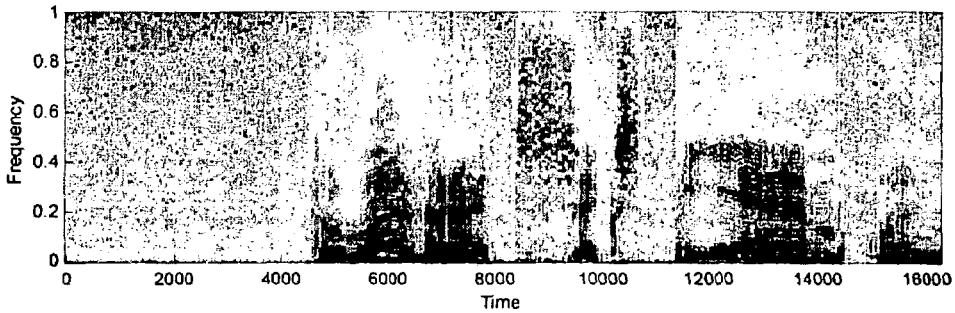
FIGS. 16 (*a*) and (*b*) show spectrogram of the original speech signal and the spectrogram of reconstructed synthesized signal respectively, using VQMND-Ms at 1 pbs.
Figure 16B:
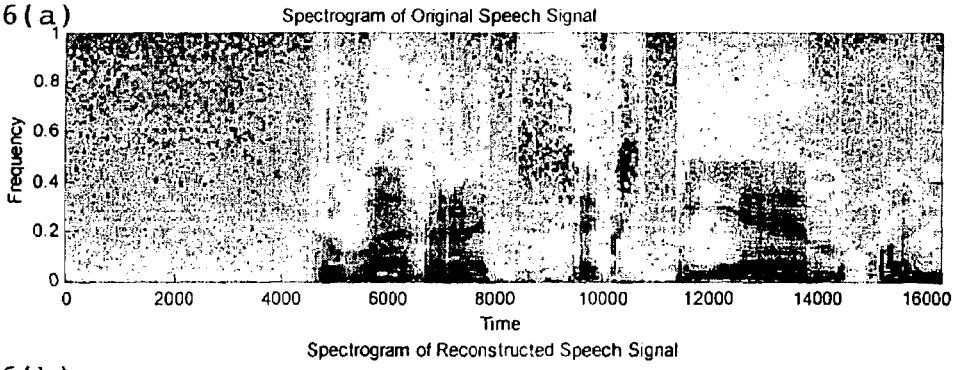

The SNR, calculated by equation 21, as a function of the overall bps for the testing vector set, when the proposed LP-MND-VQ technique with an adaptive codebook design is used for the following two cases; (I) to encode the LP coefficients alone (unquantized prediction residuals are used in the reconstruction); and, (ii) to encode the LP coefficients and the ECPR, is given in FIG. 14(*a*) and FIG. 14(*b*) respectively. The sample results presented here, confirmed by extensive simulations, indicate a significant improvement in terms of the quantitative SNR. A sample reconstruction of a speech waveform employing the proposed VQMND-Ms for a bit rate of 1 bit/sample is shown in FIG. 15. The spectrograms of the original signal and the reconstructed synthesized speech signal are shown in FIG. 16.

Section 4. Adaptive Codebook Accuracy Enhancement (ACAE) Algorithm

In this section, an Adaptive Codebook Accuracy Enhancement (ACAE) algorithm for Vector Quantization in Multiple Nonorthogonal Domains (VQMND) is developed and presented. Due to the nature of the VQMND techniques, as will be shown in this contribution, considerable performance enhancement can be achieved if the ACAE algorithm is employed to redesign the codebooks. The proposed ACAE algorithm enhances the accuracy of the codebooks in a given domain by iteratively redesigning the codebooks with only those training vectors, which are better represented in that domain. The ACAE algorithm presented here is applicable to both VQMND-W and VQMND-M. Extensive simulation results yield enhance performance of the VQMND-W and VQMND-M, for the same data rate, when the improved codebooks obtained using ACAE, are used.

4.1 ACAE for VQMND

Figure 17:
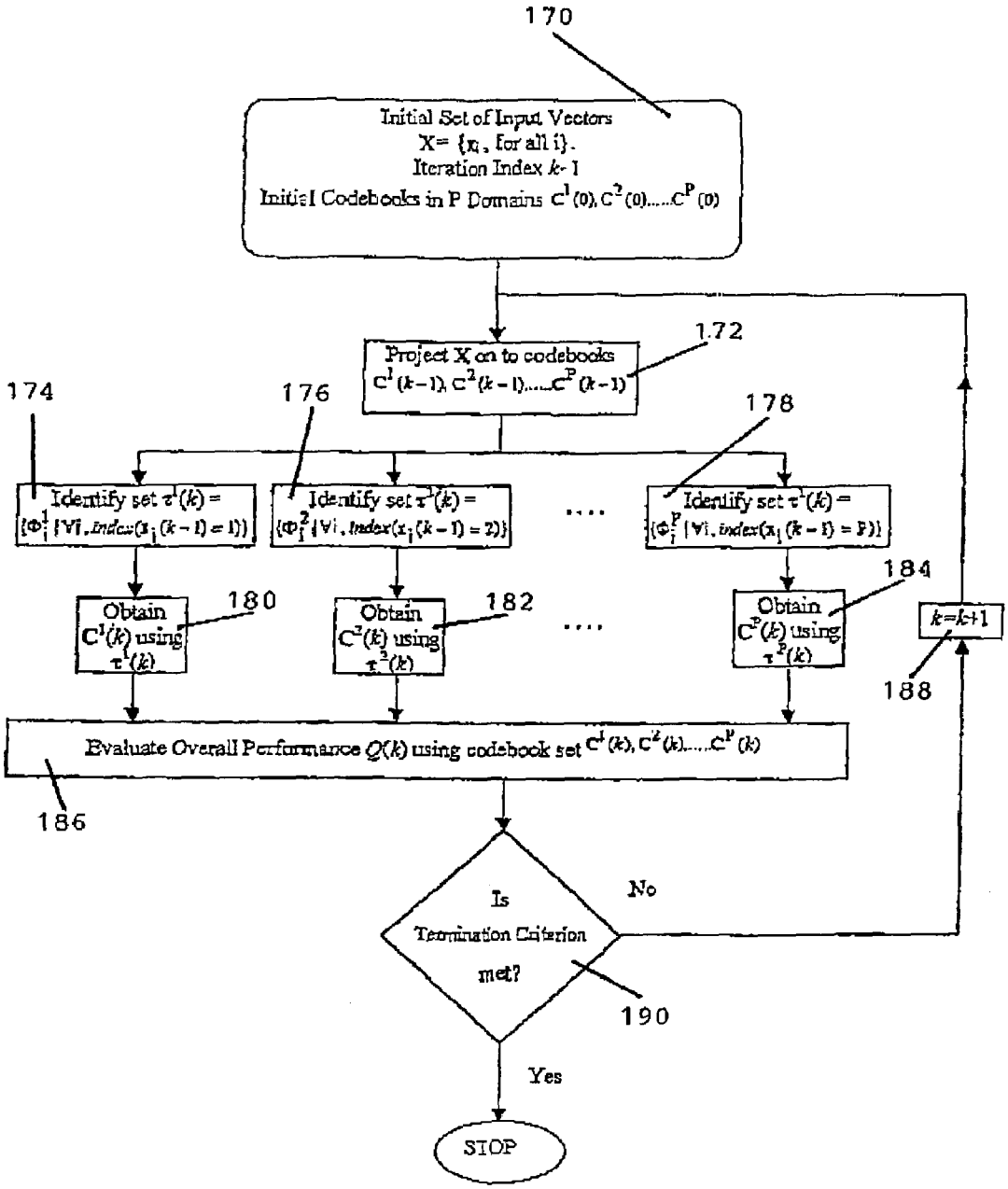
FIG. 17 shows a flow chart for the Adaptive Codebook Accuracy Enhancements (ACAE) algorithm.

FIG. 17 gives an algorithmic overview of the proposed technique. The initial set of training vectors, designated $X=\{x_i$, for all i) is simultaneously projected onto P nonorthogonal domains. The initial set of codebooks in the P domains of representation, designated $C^1(0), C^2(0), \ldots C^P(0)$ respectively, is obtained by using an algorithm such as k-means to cluster the representation of X in each domain. Thus, the codebook $C^j(0)$, in domain j, is obtained from the training vector set $\tau^j(0)=\{\Phi_i^j$ for all i$\}$. The initial cluster center is chosen according to one of the commonly used initialization techniques given in [see Gersho A.; and Gray R. M., "Vector Quantization and Signal Compression," Kluwer Academic Publishers, 1991.].

During the first iteration of the ACAE algorithm, vectors from X, that chose domain j, when coded using the initial codebook set $C^1(0), C^2(0), \ldots C^P(0)$, are selected and the corresponding $\Phi_i^j$ are collected to form the modified training vector ensemble designated $\tau^j(1)$ 174, 176, 178. In other words, the modified training vector ensemble designated $\tau^j(1)$ is obtained by $$\tau^j(1)=\{\Phi_i^j| \text{ for all i, index}(x_i(0))=j\} \tag{22}$$

Here, the mapping, b=index $(x_i(0))$ indicates that for a given vector, $x_i$, the domain be was chosen, when the set of codebooks $C^1(0), C^2(0), \ldots C^P(0)$ in iteration k=0 were used.

The codebook $C^j(0)$ is redesigned to obtain the improved codebook $C^j(1)$ by forming clusters from the modified training vector set $\tau^j(1)$. The cluster centers of the $C^j(0)$ are used to initialize the cluster centers for designing the codebook set $C^j(1)$. The same procedure is followed to update the codebook set in all domains, i.e., for j=1,2, . . . , P as indicated by 180, 182 and 184.

The ACAE algorithm is repeated until a performance objective is met via 188 as indicated in block 186. In the $k^{th}$ iteration, the modified training vector ensemble in domain j is obtained by $$\tau^j(k)=\{\Phi_i^j|\text{ for all i, index }(x_i(k-1))=j\} \tag{23}$$

The final cluster centers of $C^j(k-1)$ are used to initialize the cluster centers for $C^j(k)$.

The performance criteria evaluated at the $k^{th}$ iteration is denoted Q(k). An example of Q(k) is the Signal to Noise Ratio (SNR) evaluated for encoding the training signal using VQMND with codebook set $C^j(k)$ for j=1,2, . . . P. In this case, Q(k) is computed as follows. Let S(n) be the input signal and $\hat{S}_k(n)$ the reconstructed signal obtained using either VQMND-W or VQMND-M. The subscript k indicates that the codebooks from the $k^{th}$ iteration of the ACAE algorithm are used. The Signal to Noise Ratio for the $k^{th}$ iteration of the ACAE algorithm is given by $$Q(k) = SNR(k) = 10\log_{10}\left[\frac{\sum_n (S(n))^2}{\sum_n \left(S(n)-\hat{S}_k(n)\right)^2}\right] \tag{24}$$

It must be noted that, n represents the sample index in the signal.

While the SNR 190 is used for performance evaluation in the simulations here, other case specific objective measures may also be gainfully employed.

4.2 ACAE for Split VQMND

The ACAE algorithm can be easily extended to Split VQNMD discussed earlier. Each input vector, $x_i$, may be vector quantized in a domain j by projecting the subvectors of its representation $\Phi_i^j=[\Phi_{i1}^j, \Phi_{i2}^j, \ldots \Phi_{iL}^j]$, onto the corresponding codebooks $[C_1^j(0), C_2^j(0), \ldots C_L^j(0)]$. concatenating, and inverse j transforming the representative vectors from each codebook. The quantized reconstruction of $x_i$ employing vector quantization in domain j is denoted $\hat{x}_i^j(0)$. The index (0) corresponds to the iteration index k=0.

In the first iteration of the codebook improvement, the initial codebooks in the domain j, $[C_1^j(0), C_2^j(0), \ldots C_L^j(0)]$, are improved by modifying the respective training vector ensemble to include only subvectors whose corresponding $x_i$ chose domain j for their representation. In other words, the training vector ensemble for the subvector 1 in domain j is given by $$\tau_L^i(1)=\{\Phi_{iL}^j|\text{ for all i , index }(x_i(0))=j\} \tag{25}$$

The improved codebook set $C_1^j(1)$ in each domain j is designed by employing a clustering algorithm on the corresponding training vector ensemble $\tau_1^j(1)$. The initial cluster centers for the clustering algorithm are selected to be the set $C_1^j(0)$.

The codebook update algorithm is repeated and terminated and when the performance objective Q(k) is satisfied or no appreciable improvement is achieved.

4.3 Performance Evaluation of the ACAE Algorithm for VQNMD Speech Coding

In this Section, the performance of the proposed ACAE algorithm is evaluated for speech codec based on VQMND technique using the Signal to Noise Ratio measure given by (24). An overlapping symmetric trapezoidal window 128 samples long is used. The middle nonoverlapping flat portion is 96 samples long.

4.4 Improved VQMND-W using ACAE

The performance of the ACAE algorithm described in the previous Section is evaluated for VQMND-W. The vectors formed from the windowed signal are projected onto two nonorthgonal transform domains, DCT and Haar, i.e., P=2. The DCT and Haar transform domains are used since these were previously shown to augment each other in representing narrowband and broadband signals [see Berg, A. P., and Mikhael, W. B., "A survey of mixed transform techniques for speech and image coding," Proc. of the 1999 IEEE International Symposium Circ. and Syst., ISCAS '99, vol. 4, 1999.]. The vectors formed are split into four subvectors, i.e., L=4, and an initial set of codebooks $[C_1^1(0), C_2^1(0), C_3^1(0), C_4^1(0)]$, and $[C_1^2(0), C_2^2(0), C_3^2(0), C_4^2(0)]$ in domains 1, and 2, respectively are designed. The codebooks in each domain are now modified by the ACAE algorithm described above. At the end of each iteration, the performance is evaluated in terms of SNR (k).

Figure 18:
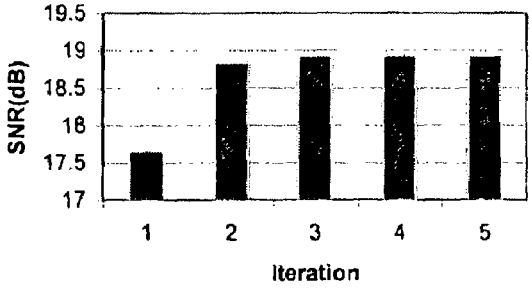
FIG. 18 (*a*) shows SNR improvement (training mode) vs. iteration index employing the ACAE algorithm applied to VQMND-W for 1.125 bps.
Figure 18B:
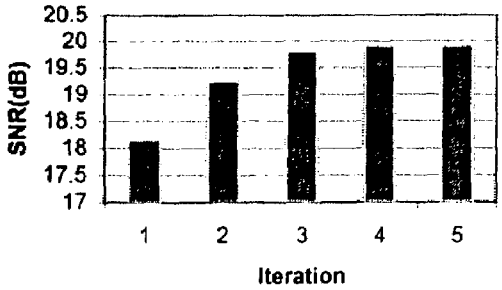
Figure 18C:
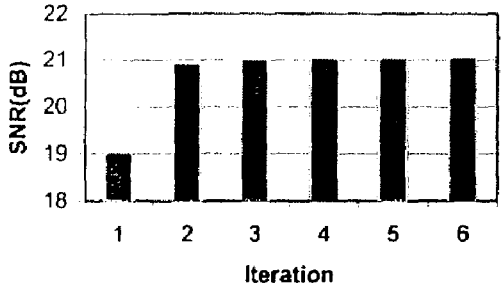
Figure 19:
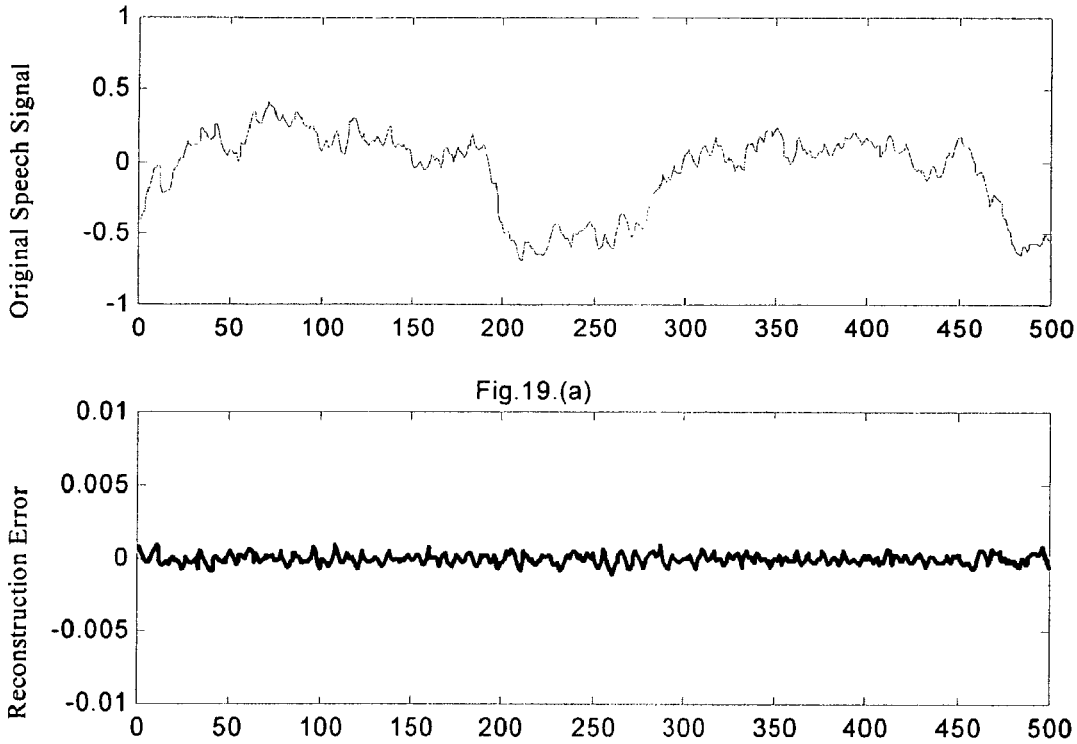
FIG. 19 (*a*) and (*b*) show results of speech waveforms employing the ACAE algorithm for VQMND-W before and after reconstruction, respectively.
Figure 20A:
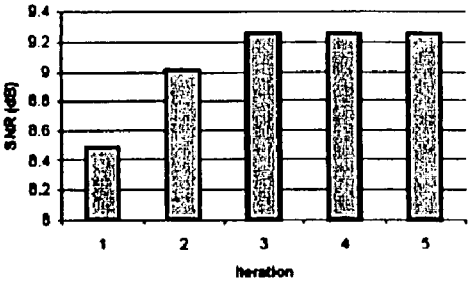
FIG. 20 (*a*) shows SNR improvement (training mode) vs. iteration index employing the ACAE algorithm applied to VQMND-W for 0.75 bps.
Figure 20B:
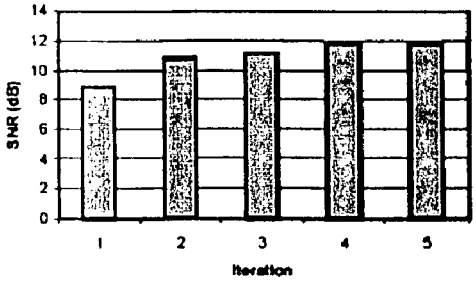
Figure 20C:
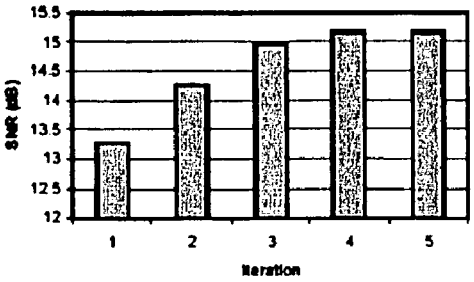
Figure 20D:
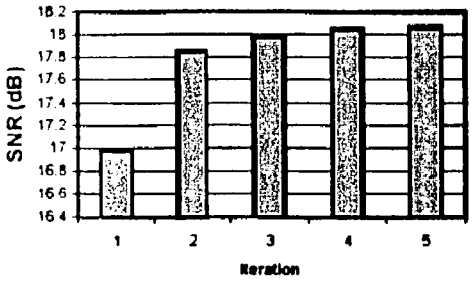

FIG. 18 shows the plot of the SNR(k) vs. iteration number k for different coding rates measured in bits per sample (bps). Sample results are shown in FIG. 19., for a speech waveform S(n) and the corresponding reconstruction error $[S(n)-\hat{S}_k(n)$, for k=4, when VQMND-W is used with, and without the ACAE algorithm. The coding rate is 2 bps.

4.5 Improved VQMND-M Using the ACAE Algorithm

To demonstrate the performance of the proposed VQMND-M, speech signal sampled at 8 KHz is chosen. Each window length, N, is selected to be 128 that represents 165 msec of the speech signal. Two equivalent nonorthgonal representations of the LP coefficients. Log Area Ratios (LAR), and Line Spectral Pairs (LSP), are used, i.e., P=2. The LAR, and the LSP representations are used for the LP coefficient encoding since they guarantee the stability of the speech synthesizer. The vector formed in each domain of representation of the LP parameters is then split into two subvectors, i.e., L=2.

The prediction residuals, $R_i$, for the $i^{th}$ frame are split into four segments $R_{i1}, R_{i2}, R_{i3}, R_{i4}$ each containing 32 residuals. Each segment is transformed into two linear transform domain representations, DCT and Haar. Thus P=2 and $\Psi_{ik}^1$ and $\Psi_{ik}^2$ represent the DCT and Haar coefficient vector of the $k^{th}$ subvector of the $i^{th}$ segment. Each vector, $\Psi_{ik}^j$, in each domain is now split into four subvectors. Thus $\Psi_{ik}^j$ is split into $[\Psi_{ik,1}^j, \Psi_{ik,2}^j, \Psi_{ik,3}^j, \Psi_{ik,4}^j]$.

The training vector ensemble for the design of the LP Parameter codebooks $C_1^j, C_2^j, \ldots C_L^j$, for j=1,2 . . . P, and the residual codebooks $C_{k,1}^j$, for k=1,2 . . . M and q=1, 2 . . . Q, are formed from a long duration recording (3 minutes) of a speech signal. Each set of codebooks in a given domain of representation for the LP parameters $C_1^j$, $C_2^j, \ldots, C_L^j$ for j=1,2 and for the prediction residuals $C_{k,q}^j$, for k=1,2 . . . , 4, and q=1,2, . . . 4,is then re-designed using a modified training vector ensemble formed using only those training vectors that are better represented in that domain, i.e., those vectors that selected that particular domain of representation.

Figure 21A:
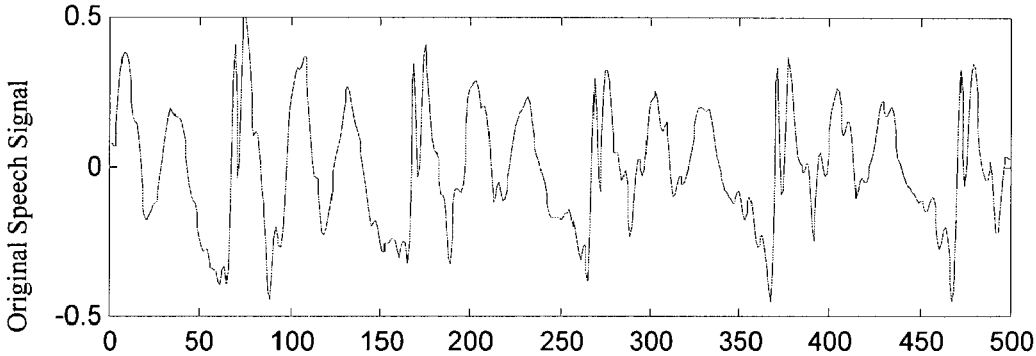
FIG. 21 (*a*) and (*b*) show speech waveforms employing the ACAE algorithm for VQMND-M before and after reconstruction, respectively.
Figure 21B:
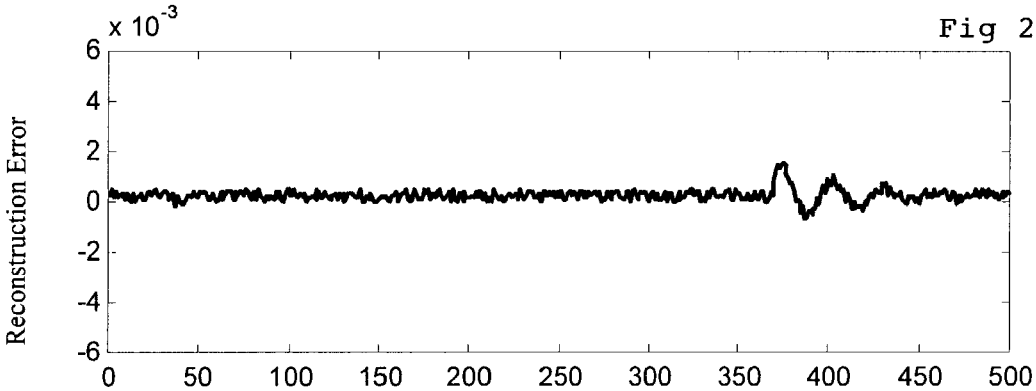

At the end of each iteration, the performance employing the latest set of improved codebooks is evaluated in terms of SNR (k). FIG. 20 shows the plot of the SNR (k) vs. the iteration number k for different coding rates measured in bits per sample. It is observed that an improvement of 2 to 3 dB is achieved in terms of the SNR in three to four iterations of the ACAE algorithm. Sample results are shown in FIG. 21, for a speech waveform S(n) and the corresponding reconstruction error $[S(n)-\hat{S}_k(n)$, for k=4, when VQMND-M is used with, and without the ACAE algorithm. The coding rate is 1 bps.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A method for preparation of a multiple transform split vector quantizer codebook comprising the steps of:

(a) forming signal vectors from a predetermined number of successive samples of speech;

(b) normalizing an energy in each signal vector;

(c) transforming each normalized signal vector simultaneously into multiple linear transform domains;

(d) splitting the transformed normalized signal vectors from step (c) into subbands M of different lengths, each containing approximately 1/M of a total normalized average signal energy to obtain corresponding training subvectors; and (e) clustering the training subvectors by means of a k-means clustering algorithm for preparation of the multiple transform split vector quantizer codebook.

2. The method of claim 1 wherein said normalizing is 8 bit.

3. A method for multiple transform split vector quantizer encoding of an input speech vector comprising the steps of:

(a) partitioning plural different signal vectors formed from the input speech vector to form plural subvectors;

(b) mapping each of plural formed subvectors to a corresponding codebook as code words in multiple transform domains simultaneously;

(c) concatenating the resulting code words for each codebook;

(d) determining a domain whose representative vector best approximates the input vector in terms of a least squared distortion;

(e) concatenating the representative vectors of subband sections of that domain;

(f) choosing the resulting domain vector to represent the input vector and as an index appended to the code word for the multiple transform split vector quantizer encoding of the input vector.

4. A system for vector quantization of input speech data in multiple domains comprising:

a processing device for executing a set of instructions, said processing device including a memory for storing said set of instructions, the set of instructions comprising:

(a) a first instruction for initially passing the input speech data separately through plural non orthogonal transform domains simultaneously;

(b) a second instruction for passing said data into a learning mode;

(c) a third instruction for compressing said data in a multiple transform split vector quantization codebook;

(d) a fourth instruction for evaluating each of the different domains to determine which domain represents the transmitted data; and, (e) a subset of instructions for system automatically selecting the domains which are better suited for the particular signal being transmitted to improve transmission of different types of data within a limited bandwidth using the vector quantization of input data in multiple domains.

5. The system of claim 4 wherein the data signal transmissions in each domain uses a coding scheme.

6. The system of claim 4 wherein the evaluating is measured by determining least distortion.

7. A method for iterative codebook accuracy enhancement for Vector Quantization comprising the steps of:

(a) simultaneously projecting an initial set of training vectors of original signal onto plural nonorthogonal domains;

(b) obtaining an initial set of codebooks in each of the plural domains of representation;

(c) selecting vectors from the initial set of training vectors that chose a first domain, when coded using the initial codebook set;

(d) collecting a corresponding representation of the input vector $\Phi_i^1$ to form a modified training vector ensemble;

(e) redesigning said initial set of codebooks to obtain the improved codebook set in all domains; and, (f) continuing the redesigning of the improved codebook set in all domains as set forth in the preceding steps until a performance improvement in signal coding performance of both waveform and model based Vector Quantization in Multiple Nonorthogonal Domains is realized.

8. An iterative codebook accuracy enhancement method according to claim 7 wherein the initial codebooks in the domain are modified to limit the respective training vector ensemble to include only subvectors whose corresponding input vector choose the first domain for their representation whereby speech reconstruction quality for the same bit rate is markedly improved in performance.

* * * * *